US008506472B2

(12) United States Patent
Matsubara et al.

(10) Patent No.: US 8,506,472 B2
(45) Date of Patent: Aug. 13, 2013

(54) INCUBATOR

(75) Inventors: Terumi Matsubara, Saitama (JP); Eiji Koike, Saitama (JP); Keisuke Wakabayashi, Saitama (JP); Shinichi Kobayashi, Saitama (JP); Naoki Honma, Saitama (JP); Kazuo Matsubara, Bunkyo-ku (JP)

(73) Assignee: Atom Medical Corporation, Tokyo (JP)

( * ) Notice: Subject to any disclaimer, the term of this patent is extended or adjusted under 35 U.S.C. 154(b) by 833 days.

(21) Appl. No.: 12/577,478

(22) Filed: Oct. 12, 2009

(65) Prior Publication Data

US 2010/0113864 A1 May 6, 2010

(30) Foreign Application Priority Data

Oct. 23, 2008 (JP) ..... 2008-272984

(51) Int. Cl.
*A61G 11/00* (2006.01)

(52) U.S. Cl.
USPC ..... 600/22

(58) Field of Classification Search
USPC ..... 600/21, 22; 128/897, 899; 312/1, 312/2; 2/270; D24/232; 119/311, 328, 481, 119/484, 494, 501, 524; 49/149, 150, 158, 49/164
See application file for complete search history.

(56) References Cited

U.S. PATENT DOCUMENTS

| | | | | |
|---|---|---|---|---|
| 4,773,392 | A * | 9/1988 | Koch | 600/22 |
| 6,063,020 | A | 5/2000 | Jones et al. | |
| 6,224,539 | B1 | 5/2001 | Jones et al. | |
| 6,231,499 | B1 | 5/2001 | Jones | |
| 6,893,390 | B1 | 5/2005 | Mackin | |
| 7,282,022 | B2 | 10/2007 | Falk et al. | |

FOREIGN PATENT DOCUMENTS

| | | |
|---|---|---|
| JP | 2000-148416 | 5/2000 |
| JP | 2004-275691 | 9/2004 |

* cited by examiner

*Primary Examiner* — Charles A Marmor, II
*Assistant Examiner* — Shannon Canty
(74) *Attorney, Agent, or Firm* — Hunton & Williams LLP

(57) ABSTRACT

In an incubator according to the present invention, a single incubator can be used in any state of four types of devices and thus obviates the need for having many types of devices. A canopy is lowered and raised. In addition to that, a left and right treatment door and a foot end treatment door can be located at their highest positions, lowest positions, and intermediate positions. Also, an infrared heater can be lowered and raised independently of the canopy. This makes it possible to switch the incubator among: a state of an open type incubator; a state of a closed type incubator in which the infrared heater is at its highest position such that the infrared heater can heat the canopy and others; a state of a closed type incubator in which the infrared heater is at its lowest position and this incubator is easily conveyable; and a state of a resuscitation treatment device.

17 Claims, 37 Drawing Sheets

INCUBATOR

TECHNICAL FIELD

The present invention relates to an incubator having: a treatment window formed in a side of a newborn chamber; a treatment door for opening and closing the treatment window; a canopy for closing and opening the top of the newborn chamber by lowering and rising; and a heater for heating the newborn chamber.

BACKGROUND ART

An incubator has a newborn chamber for providing an appropriate physiological environment for a newborn. In a closed type incubator, not only temperature but also humidity, oxygen concentration, and others in the newborn chamber enclosed by sidewalls and a ceiling are controlled by a control mechanism for temperature, humidity, and others disposed below the newborn chamber. In an open type incubator, a newborn chamber does not have a ceiling and, in addition, the sidewalls are slightly lower than those of the closed type incubator so that a treating person such as a doctor or a nurse can treat a newborn in the newborn chamber promptly. Even in the open type incubator, a bed in a newborn chamber and a newborn on the bed are warmed by a heat-radiating source disposed above the newborn chamber.

It is preferable that an incubator can be switched from one to another of the closed and open type incubators described above as required because it can eliminate the need to have both types of incubators. For this reason, switching type incubators have been proposed (e.g., Patent Literatures 1 and 2), which can be switched as required between the closed and open types by lowering and raising a canopy of the newborn chamber.

Incidentally, there may be a case where the inside of the newborn chamber of the closed type incubator is controlled so as to be at temperature not lower than body temperature of an adult and at a very high humidity. In this case, especially immediately after the incubator is switched from open type to closed type, dew may condense on the inner surface of the ceiling and others of the newborn chamber, due to the difference between temperature in the room where the incubator is installed and temperature at the inside of the newborn chamber. This dew condensation may encourage propagation of unwanted bacteria. In order to prevent such dew condensation, temperature difference between outer and inner surfaces of the newborn chamber has to be reduced by heating the outer surfaces of the ceiling and others of the newborn chamber. For that purpose, it is effective to heat the outer surfaces of the ceiling and others with a heat-radiating source.

The ceiling and others of the newborn chamber, however, are placed higher than the bed and a newborn on the bed. Therefore, in order to radiate heat over a broad area of the ceiling and others, the heat-radiating source has to be disposed higher than in a case where only the bed and the newborn on the bed are warmed. If, however, the heat-radiating source is disposed too high, there is a possibility that the incubator, when conveyed, can not pass through an entrance of a room or some other possibility. It is, therefore, preferable to use a closed type incubator in which the heat-radiating source is disposed at a high position when heating with this source is performed and to use a closed type incubator in which the heat-radiating source is not disposed at a high position when heating with this source is not performed.

Furthermore, a newborn in critical condition requiring a resuscitation treatment is simultaneously treated by many treating persons, and there is no danger that the newborn falls down from a bed when the many treating persons surround the bed. For these reasons, although a resuscitation treatment device has a heat-radiating source for warming the bed and a newborn on the bed, the bed has neither a ceiling nor sidewalls.

As described above, there is a possibility of, when caring for a newborn, using an open type incubator, a closed type incubator in which a heat-radiating source is disposed at a high position, a closed type incubator in which a heat-radiating source is not disposed at a high position, and a resuscitation treatment device. It is, however, not easy, in terms of cost, facilities, or others, for a maternity hospital or the like to have a number to some extent of each of these four types of devices.

CITATION LIST

Patent Literature

1. JP 2000-354615 A
2. JP 2005-103262 A

SUMMARY OF INVENTION

Technical Problem

In each of the above incubators in the Patent Literatures 1 and 2, however, even when in a state of an open type incubator, the height of its sidewalls is equal to that in a state of a closed type incubator; accordingly, this lacks a state of a preferable open type incubator, specifically, a state in which the height of the sidewalls is slightly lower than that in the closed type incubator. Moreover, the heat-radiating source does not rise or lower independently of the canopy of the newborn chamber, and a state of a resuscitation treatment device cannot be obtained either. It is thus impossible to use a single incubator in any state of the above four types of devices, and hence it is still necessary to have many types of devices. It is accordingly an object of the present invention to provide an incubator that can be used in any state of four types of devices and thus obviates the need for having many types of devices.

Solution to Problem

In an incubator according to the present invention, a canopy rises and lowers and, in addition to that, a treatment door can be located at its highest position, lowest position, and intermediate position by a treatment door raising and lowering mechanism. Additionally, a heater raising and lowering mechanism lowers and raises a heater along a path displaced from a path for lowering and raising the canopy. Accordingly, the heater can be lowered and raised independently of the canopy.

For this reason, the incubator can be switched among: a state of an open type incubator in which the canopy and the heater are at their highest positions, and the treatment door is at its intermediate position; a state of a closed type incubator in which the canopy is at its lowest position, the treatment door is at its highest position, and the heater is at its highest position, such that the heater can heat the canopy and others; a state of a closed type incubator in which the canopy is at its lowest position, the treatment door is at its highest position, the heater is at its lowest position, and this incubator is easily conveyable; and a state of a resuscitation treatment device in which the canopy and heater are at their highest positions, and the treatment door is at its lowest position.

Advantageous Effects of Invention

The incubator according to the present invention can be switched among: the state of an open type incubator in which the canopy and the heater are at their highest positions, and the treatment door is at its intermediate position; the state of a closed type incubator in which the canopy is at its lowest position, the treatment door is at its highest position, and the heater is at its highest position, such that the heater can heat the canopy and others; the state of a closed type incubator in which the canopy is at its lowest position, the treatment door is at its highest position, the heater is at its lowest position, and this incubator is easily conveyable; and the state of a resuscitation treatment device in which the canopy and the heater are at their highest positions, and the treatment door is at its lowest position. Accordingly, the single incubator can be used in any state of four types of devices. This obviates the need for having many types of devices.

DESCRIPTION OF EMBODIMENTS

Hereinafter, with referring to FIGS. 1 to 37, one embodiment of the present invention will be described. Hereinafter, the present embodiment will be described according to the following list.

Figure 2:
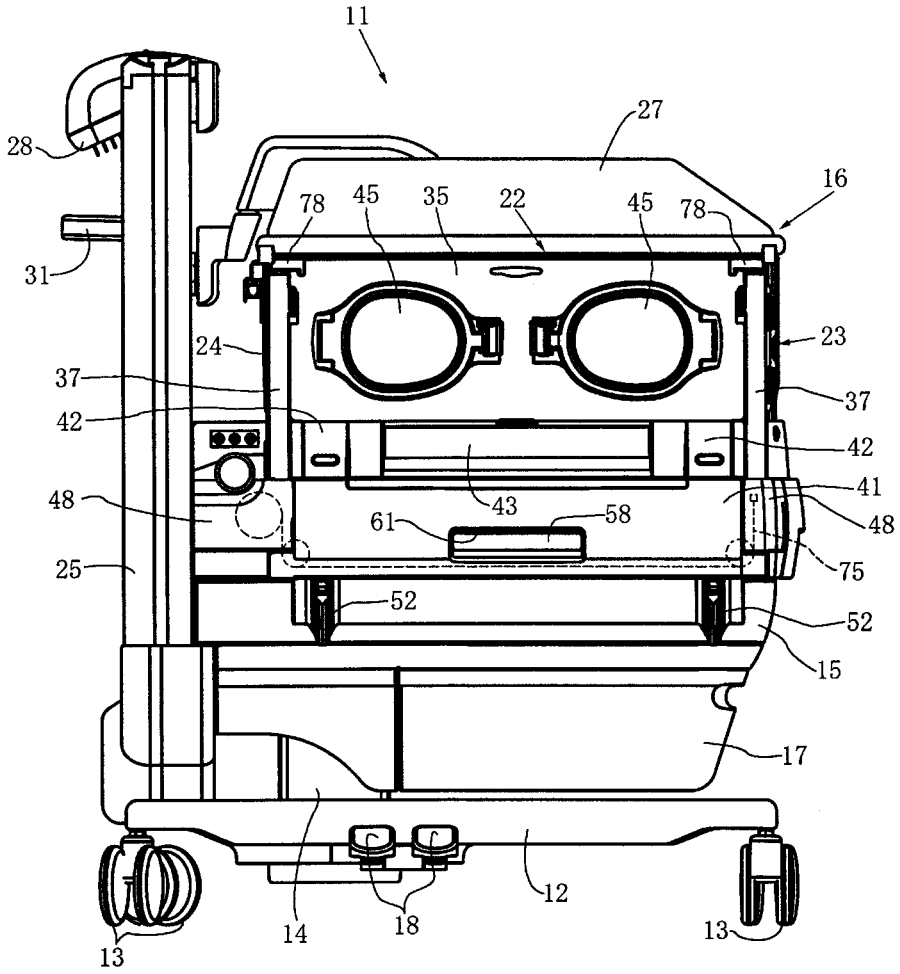
FIG. 2 Side view of the incubator according to the embodiment of the present invention as viewed from the left and right treatment door side, illustrating the state in which the incubator is in the state of the closed type incubator, the canopy and the infrared heater are at their lowest positions and the left and right treatment door and the foot end treatment door are at their highest positions.

(1) An Outline of the Overall Incubator
(2) Raising and Lowering of the Left and Right Treatment Door
(3) Rotation of the Left and Right Treatment Door
(4) Raising and Lowering of the Foot End Treatment Door
(5) Restriction of Lowering of the Foot End Treatment Door
(6) Warming or Heating with an Infrared Heater
(7) Radiation in the Newborn Chamber
(8) Four States of the Incubator (1) An Outline of the Overall Incubator FIG. 2 shows an incubator of the present embodiment in a state of a closed type. In the incubator 11, wheels 13 and a support 14 are attached to a frame 12. A base 15 is supported on the support 14. Within the base 15 is a control mechanism (not shown) for temperature, humidity, and others. Disposed on the base 15 is a newborn chamber 16. A drawer 17 for use as storage is attached to the underside of the base 15. Pedals 18 are also attached to the frame 12 in order to adjust the height of the base 15 or others along the support 14.

A bed 21 (FIG. 1) is disposed in the newborn chamber 16. Formed in the sides of the newborn chamber 16 are: a pair of left and right treatment doors 22 which is located on the left and right sides of a newborn (not shown) lying on the bed 21; a foot end treatment door 23 which is located at the foot end; and a head end treatment wall 24 which is located at the head end. A pair of left and right posts 25 is also attached to the frame 12. Another pair of left and right posts 26 (FIG. 3) is nested in the pair of left and right posts 25. Each of the posts 26 is slidable within each of the posts 25 by means of a drive mechanism such as an electric motor, drive gear, drive chain, and driven gear (none of these are shown).

Figure 33:
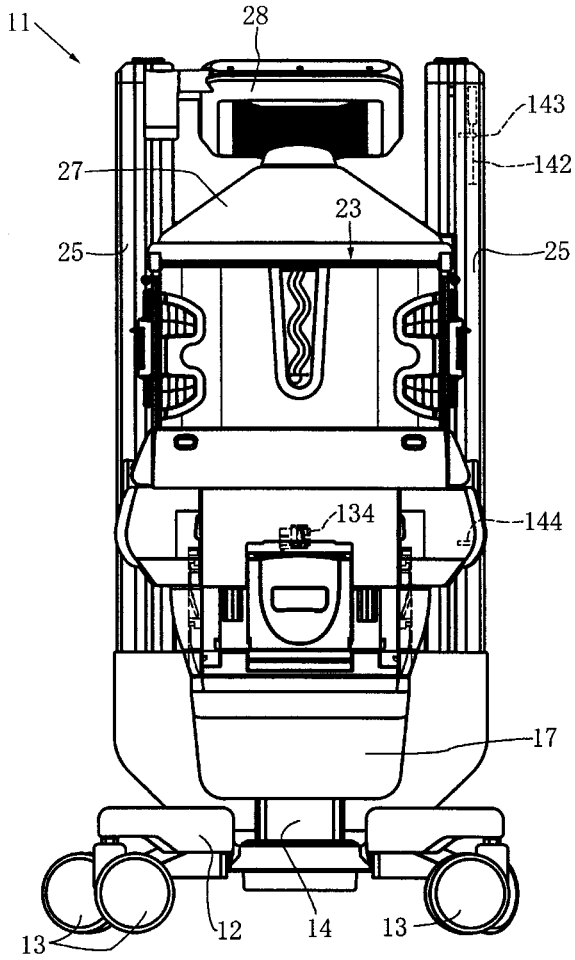
FIG. 33 Side view of the incubator according to the embodiment of the present invention as viewed from the foot end treatment door side, illustrating the state in which the incubator is in the state of the closed type incubator, the canopy and the infrared heater are at their lowest positions and the left and right treatment doors and foot end treatment door are at their highest positions.
Figure 34:
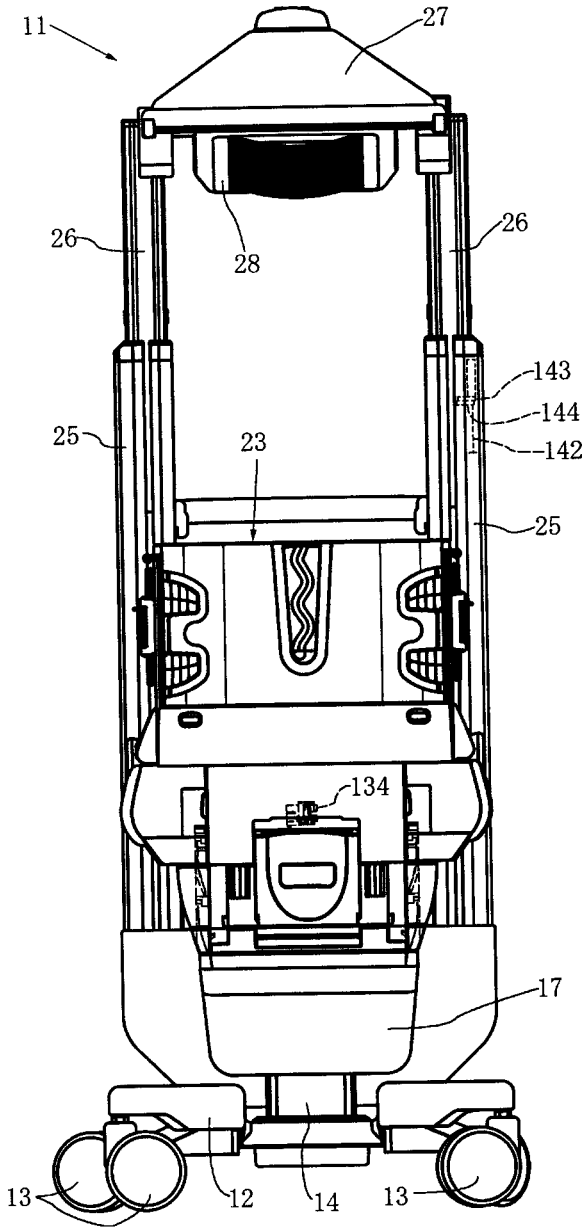
FIG. 34 Side view of the incubator according to the embodiment of the present invention as viewed from the foot end treatment door side, illustrating the state in which the canopy, the infrared heater, the left and right treatment doors, and the foot end treatment door are at their highest positions.
Figure 36:
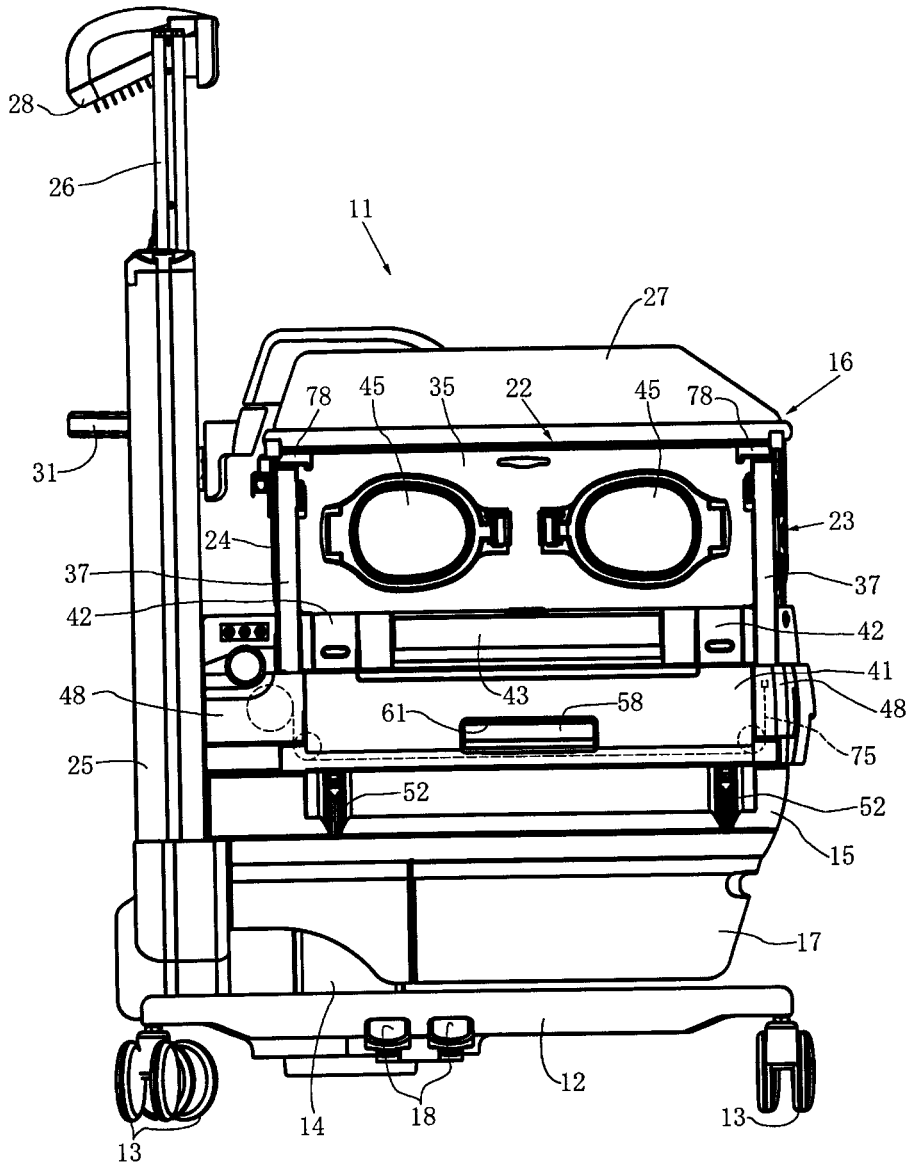
FIG. 36 Side view of the incubator according to the embodiment of the present invention as viewed from the left and right treatment door side, illustrating the state in which the incubator is in the state of the closed type incubator, the canopy is at its lowest position and the infrared heater, the left and right treatment door and the foot end treatment door are at their highest positions.
Figure 37:
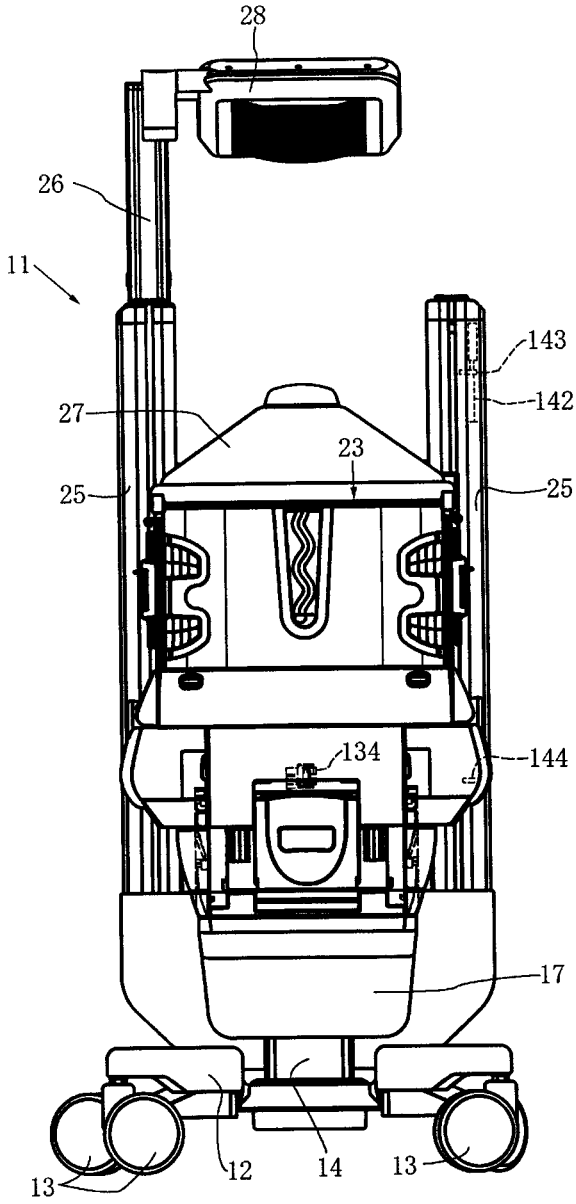
FIG. 37 Side view of the incubator according to the embodiment of the present invention as viewed from the foot end treatment door side, illustrating the state in which the incubator is in the state of the closed type incubator, the canopy is at its lowest position and the infrared heater, the left and right treatment doors and the foot end treatment door are at their highest positions.

A canopy 27 of the newborn chamber 16 and an infrared heater 28 are supported by one and the other of the pair of left and right posts 26, respectively. As shown in FIGS. 33, 34, and 37, both canopy 27 and infrared heater 28 are disposed between the pairs of left and right posts 25 and 26 as viewed from the foot end treatment door 23. As shown in FIGS. 1 to 5 and 36, however, the canopy 27 is located on the same side as the foot end treatment door 23 with respect to the posts 25 and 26, whereas the infrared heater 28 is located on the opposite side to the foot end treatment door 23 with respect to the posts 25 and 26, as viewed from the left and right treatment door 22. That is, the path for lowering and raising the canopy 27 and the path for lowering and raising infrared heater 28 are displaced from each other. The canopy 27 and the infrared heater 28 can therefore be raised and lowered independently of each other by sliding the posts 26 in the corresponding posts 25.

Figure 1:
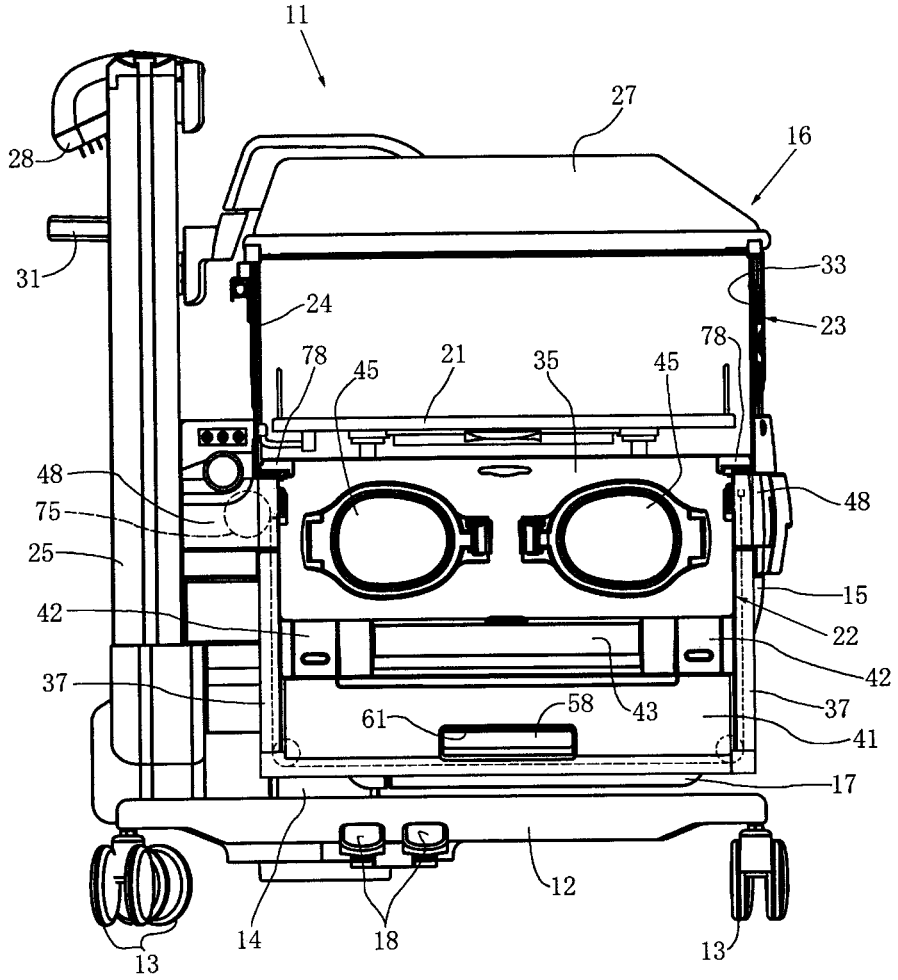
FIG. 1 Side view of an incubator according to one embodiment of the present invention as viewed from the left and right treatment door side, illustrating the state in which the incubator is in the state of a closed type incubator, a canopy, an infrared heater, and the left and right treatment doors are at their lowest positions and a foot end treatment door is at its highest position.

The canopy 27 is made of a transparent material. Also attached to one of the posts 25 is a protector 31 that prevents the infrared heater 28 from bumping against the wall (not shown) of a room. Grommets 32 (FIG. 24) for inserting various tubes or others are attached to the foot end treatment door 23 and head end treatment wall 24. The head end treatment wall 24 is fixed to the base 15 and cannot be moved, but the left and right treatment doors 22 and the foot end treatment door 23 can be raised and lowered relative to the base 15. FIG. 1 shows the state in which the left and right treatment doors 22 are moved to their lowest positions such that left and right treatment windows 33 are opened. The left and right treatment windows 33 are closed by raising the left and right treatment doors 22 from these positions to their highest positions where these left and right treatment doors 22 come into contact with the canopy 27.

Figure 3:
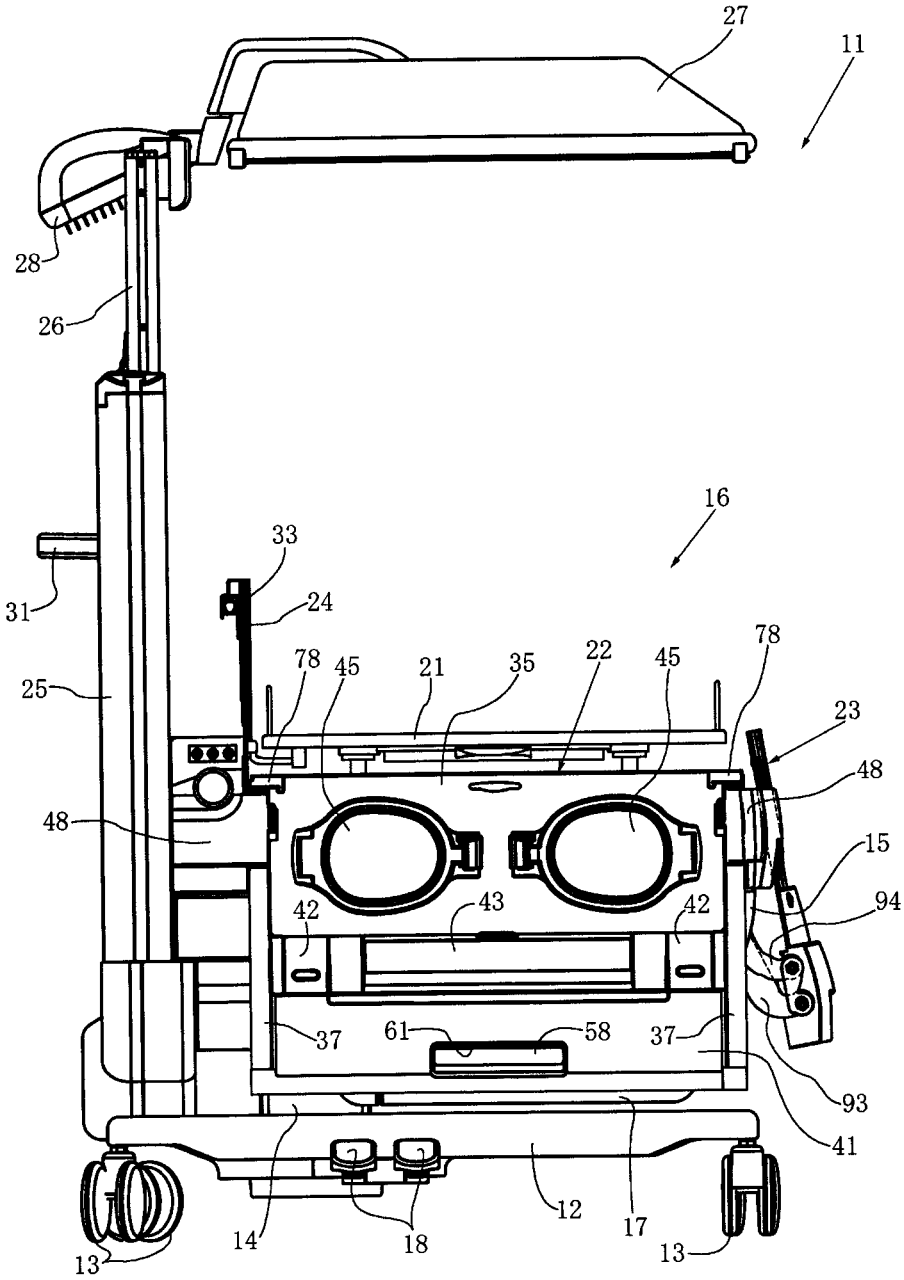
FIG. 3 Side view of the incubator according to the embodiment of the present invention as viewed from the left and right treatment door side, illustrating the state in which the incubator is in the state of a resuscitation treatment device, the canopy and infrared heater are at their highest positions and the left and right treatment doors and the foot end treatment door are at their lowest positions.
Figure 4:
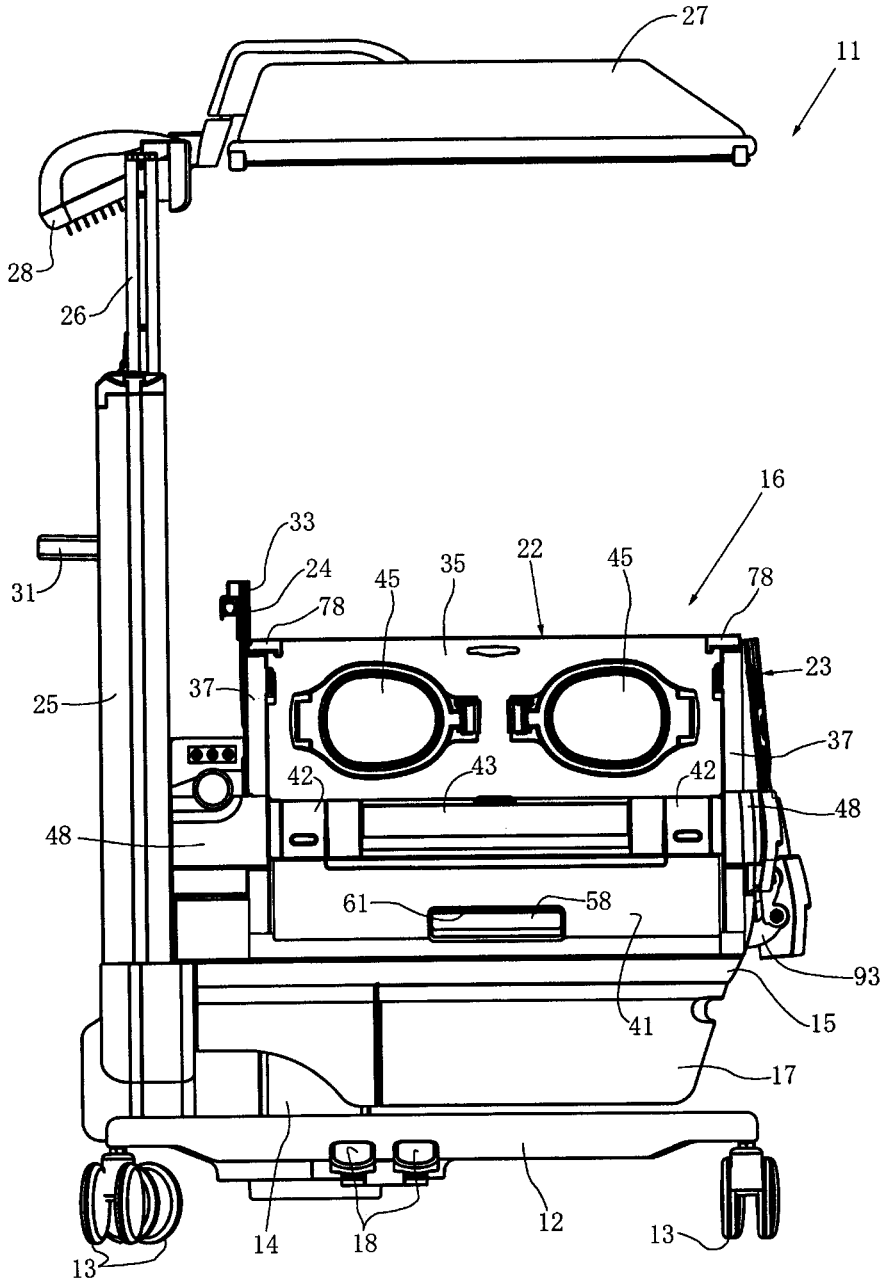
FIG. 4 Side view of the incubator according to the embodiment of the present invention as viewed from the left and right treatment door side, illustrating the state in which the incubator is in the state of an open type incubator, the canopy and the infrared heater are at their highest positions and the left and right treatment doors and the foot end treatment door are at their intermediate positions.
Figure 5:
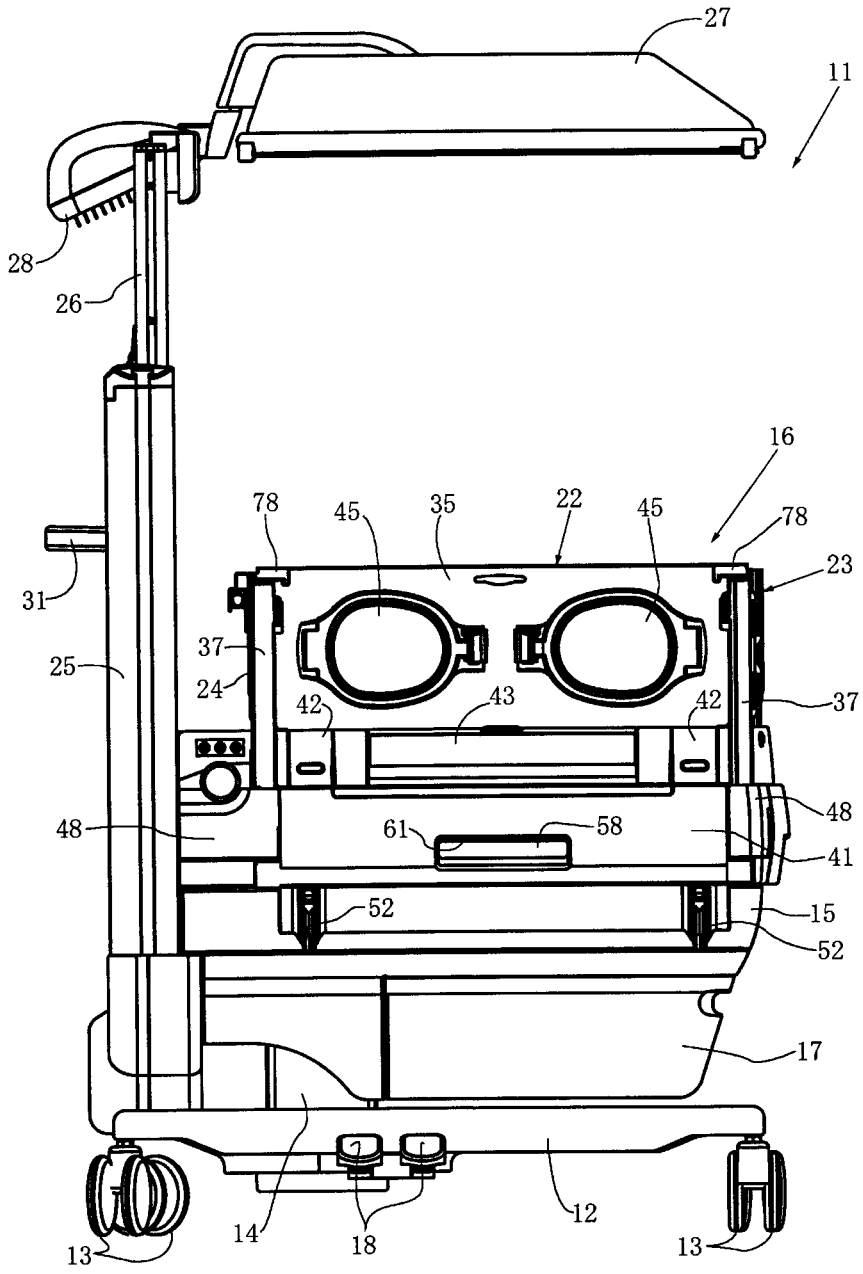
FIG. 5 Side view of the incubator according to the embodiment of the present invention as viewed from the left and right treatment door side, illustrating the state in which the canopy, the infrared heater, the left and right treatment door, and the foot end treatment door are at their highest positions.

FIG. 5 shows the state in which the left and right treatment door 22 and the foot end treatment door 23 are raised to their highest positions such that the left and right treatment window 33 and a foot end treatment window 34 (FIG. 23) are closed and the canopy 27 is raised to its highest position. Accordingly, in this state, the top of the newborn chamber 16 is open. FIG. 4 shows the state in which the left and right treatment doors 22 and the foot end treatment door 23 are lowered to their intermediate positions. FIG. 3 shows the state in which the left and right treatment doors 22 and the foot end treatment door 23 are lowered to their lowest positions. The left and right treatment doors 22 and the foot end treatment door 23 can be raised and lowered independently of each other, as described below.

(2) Raising and Lowering of the Left and Right Treatment Door

Figure 6:
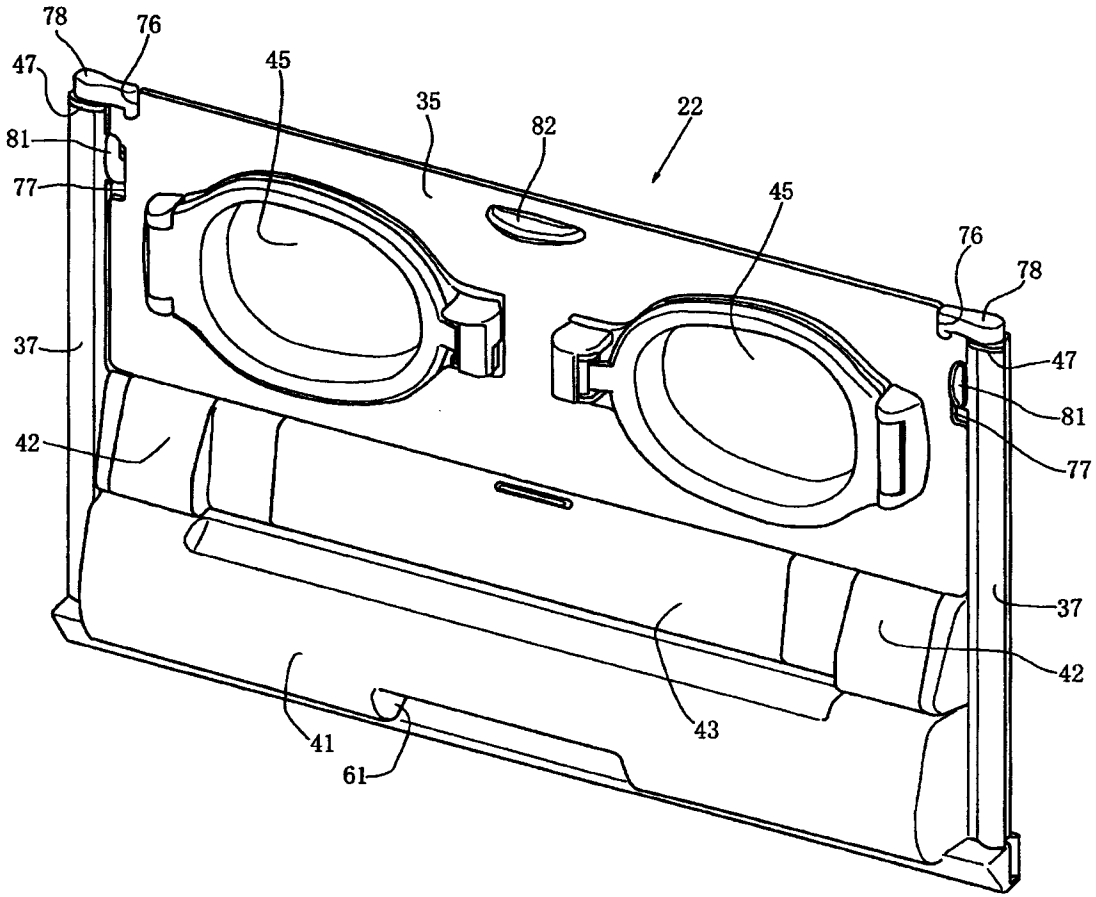
FIG. 6 Perspective view of an outer surface of the left and right treatment door of the incubator according to the embodiment of the present invention.
Figure 7:
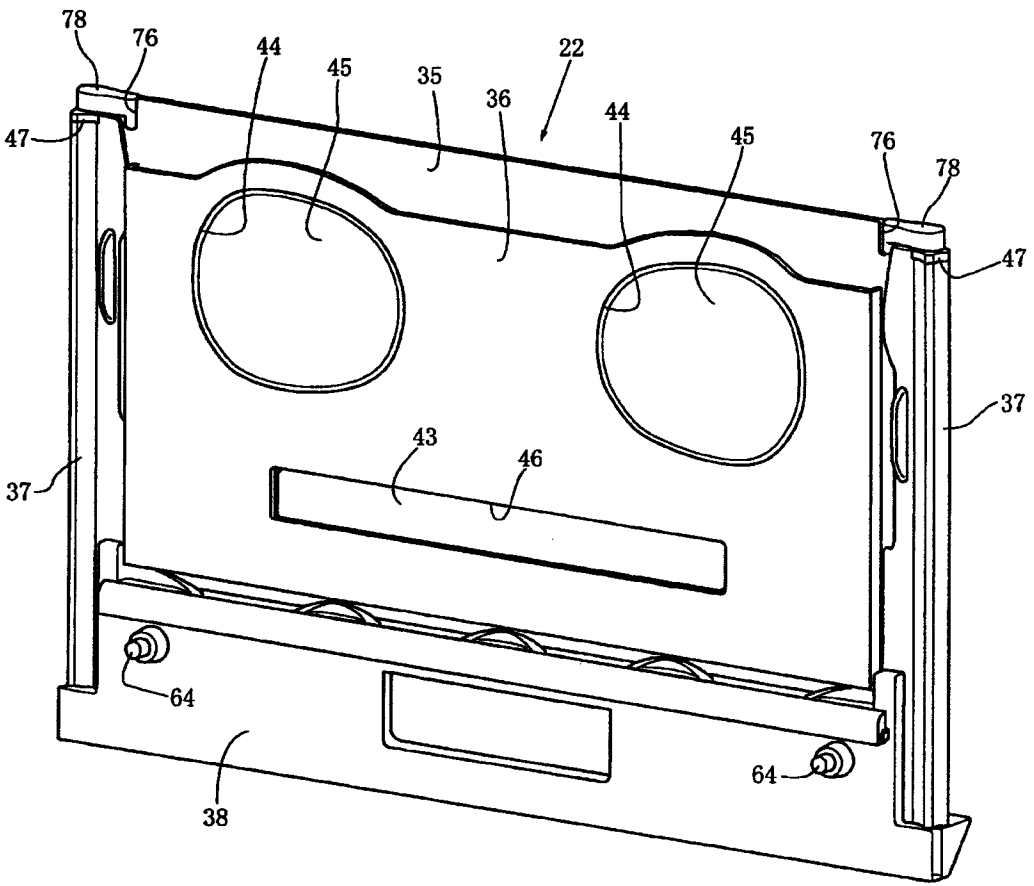
FIG. 7 Perspective view of an inner surface of the left and right treatment door of the incubator according to the embodiment of the present invention.

As shown in FIGS. 6 and 7, the left and right treatment door 22 has: an outer wall 35 and an inner wall 36 that are transparent and form a double-wall structure; a pair of left and right guided rails 37; a frame body 38; a frame body cover 41; a pair of left and right hinges 42; an X-ray cassette door 43; and others. The outer wall 35 and inner wall 36 have a pair of left and right hand insertion windows 44, a pair of left and right hand insertion doors 45 for opening and closing the corresponding hand insertion windows 44, and an X-ray cassette opening 46. Attached in the vicinity of the upper end of each of the pair of left and right guided rails 37 is a stopper 47 that has a part larger than the guided rail 37 in diameter. In order to improve the air tightness of the X-ray cassette opening 46, part of the X-ray cassette door 43 is inserted in the X-ray cassette opening 46 when closed.

Figure 8:
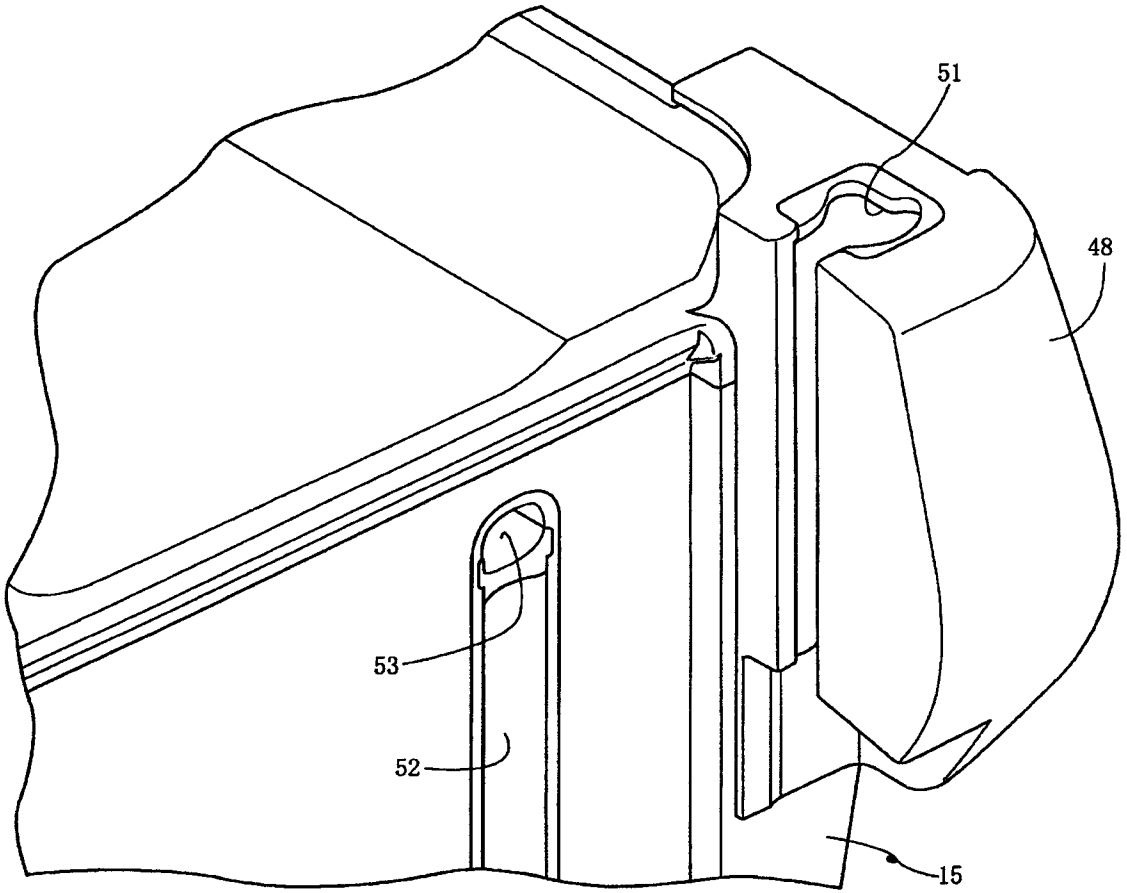
FIG. 8 Perspective view of the vicinity of a treatment door support of the incubator according to the embodiment of the present invention.
Figure 9:
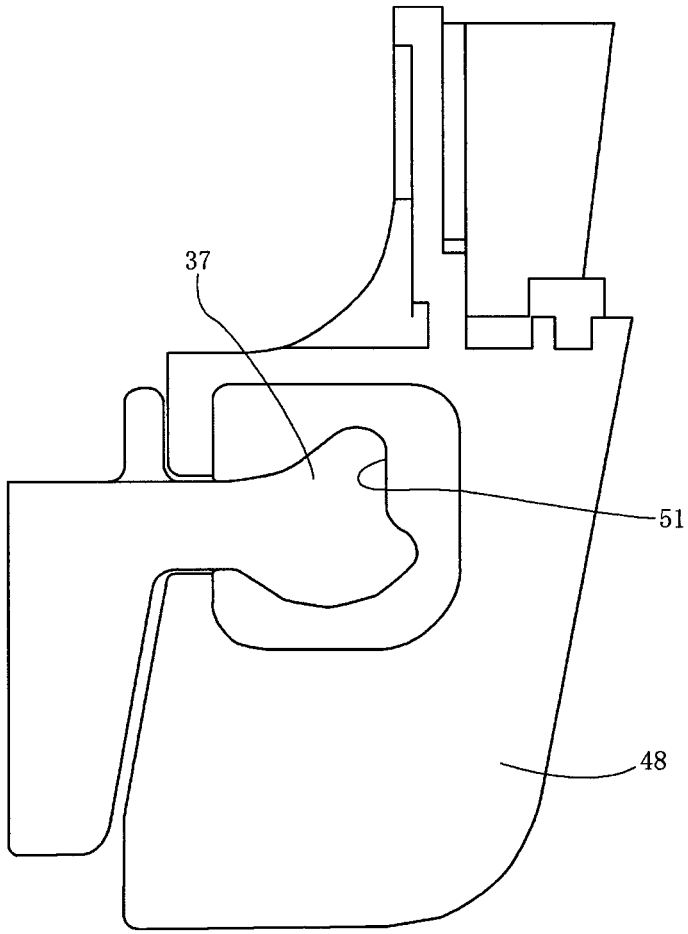
FIG. 9 Transverse sectional view of the treatment door support shown in FIG. 8.

FIGS. 8 and 9 show one of four treatment door supports 48 attached to the four corners of the base 15. The corners are parts of the base 15 which correspond to the both side edges of each of the pair of left and right treatment doors 22. The treatment door support 48 has a guide groove 51 extending vertically. When the left and right treatment door 22 is raised or lowered, the guided rails 37 at the both side edges of the left and right treatment door 22 slide in the guide grooves 51.

Figure 10:
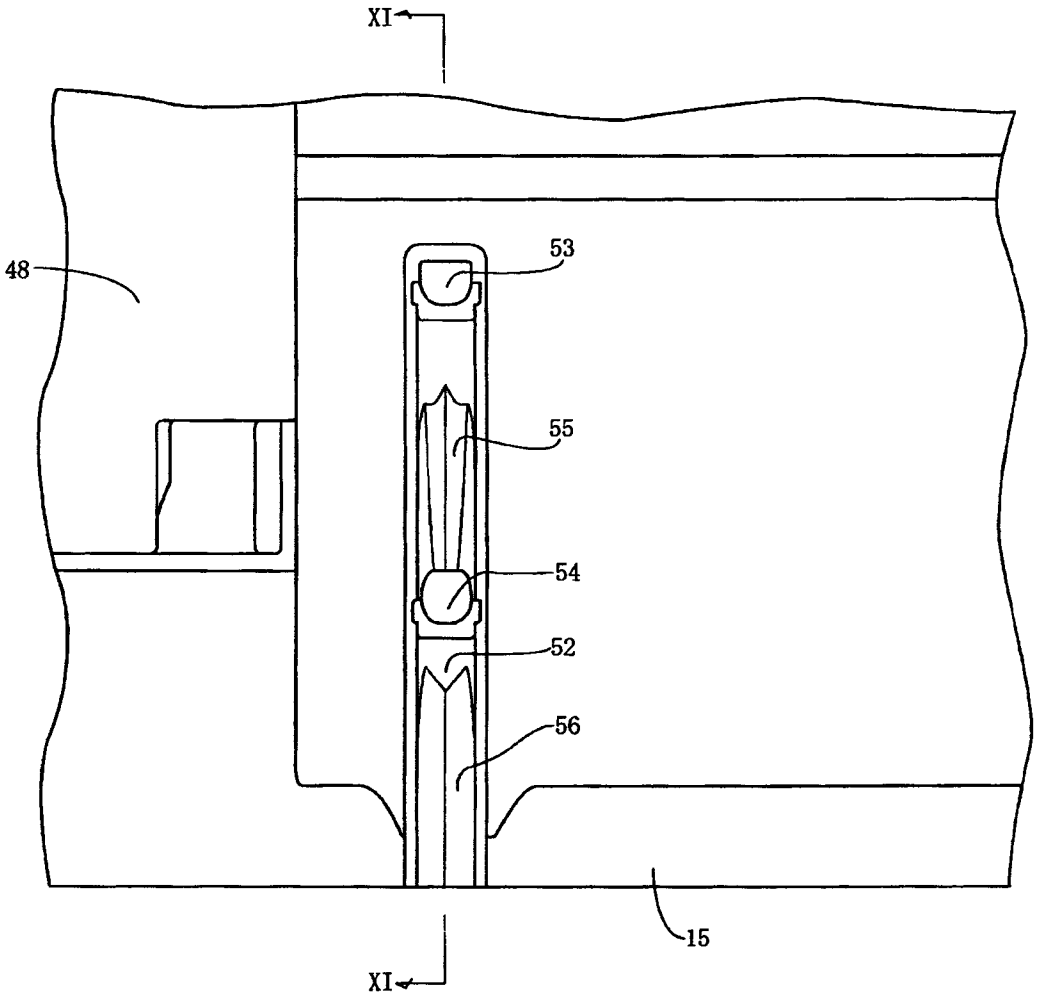
FIG. 10 Side view of part of the base of the incubator according to the embodiment of the present invention, as viewed from the left and right treatment door side.
Figure 11:
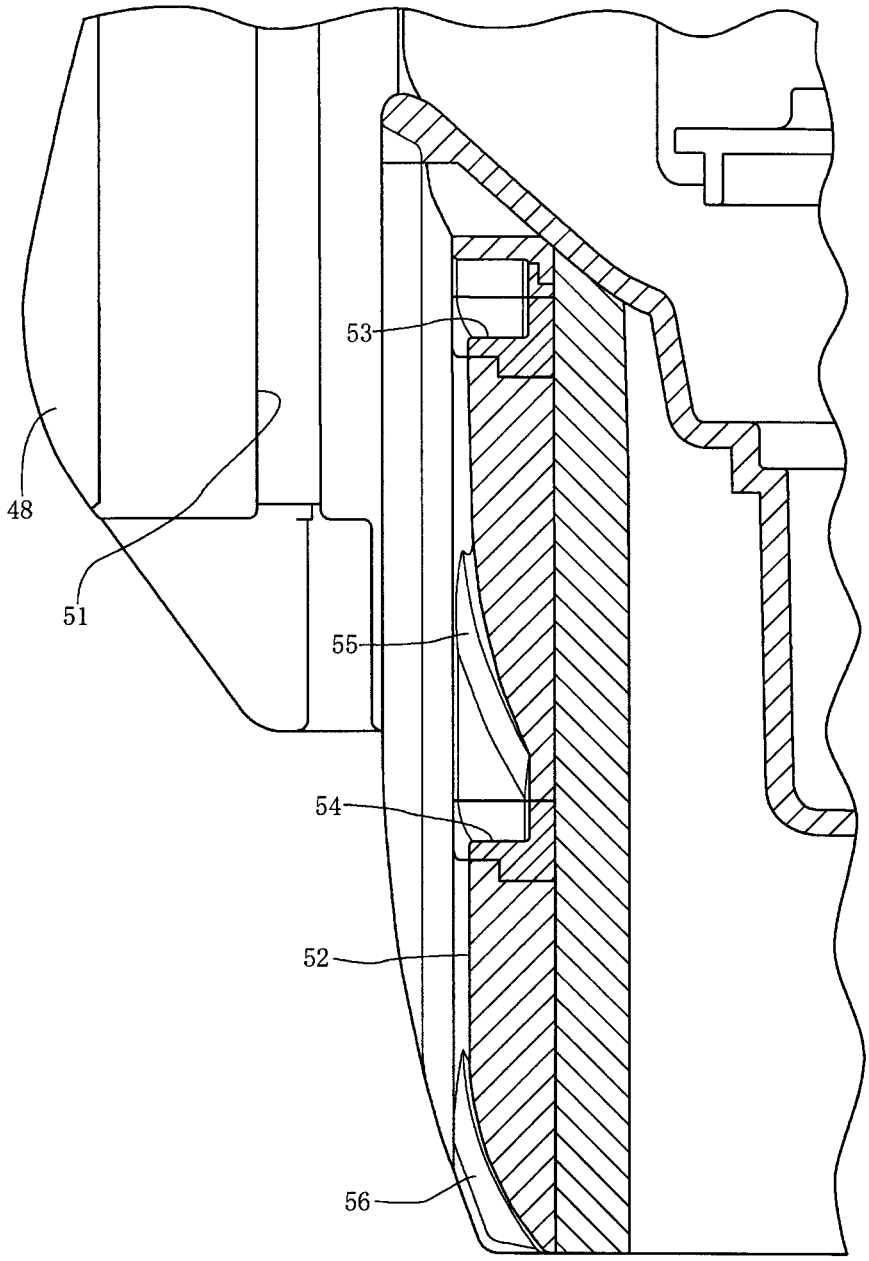
FIG. 11 Longitudinal sectional view taken along the line XI-XI in FIG. 10.

As shown in FIGS. 2, 8, and 10, a pair of engagement grooves 52 extending vertically are formed in the vicinity of the treatment door supports 48, of the sides of the base 15 that face the left and right treatment doors 22 when these left and right treatment doors 22 are raised or lowered. As shown in FIGS. 8, 10, and 11, formed at the upper end and intermediate part of the engagement groove 52 are fitting holes 53 and 54 deeper than the engagement groove 52, respectively. Additionally, as shown in FIGS. 10 and 11, the engagement groove 52 has slopes 55 and 56 along which the engagement groove 52 gradually becomes deeper. The slope 55 extends from the intermediate part between the fitting holes 53 and 54 to the fitting hole 54; and the slope 56 extends from the intermediate part between the fitting hole 54 and the lower end of the engagement groove 52 to this lower end.

Figure 12:
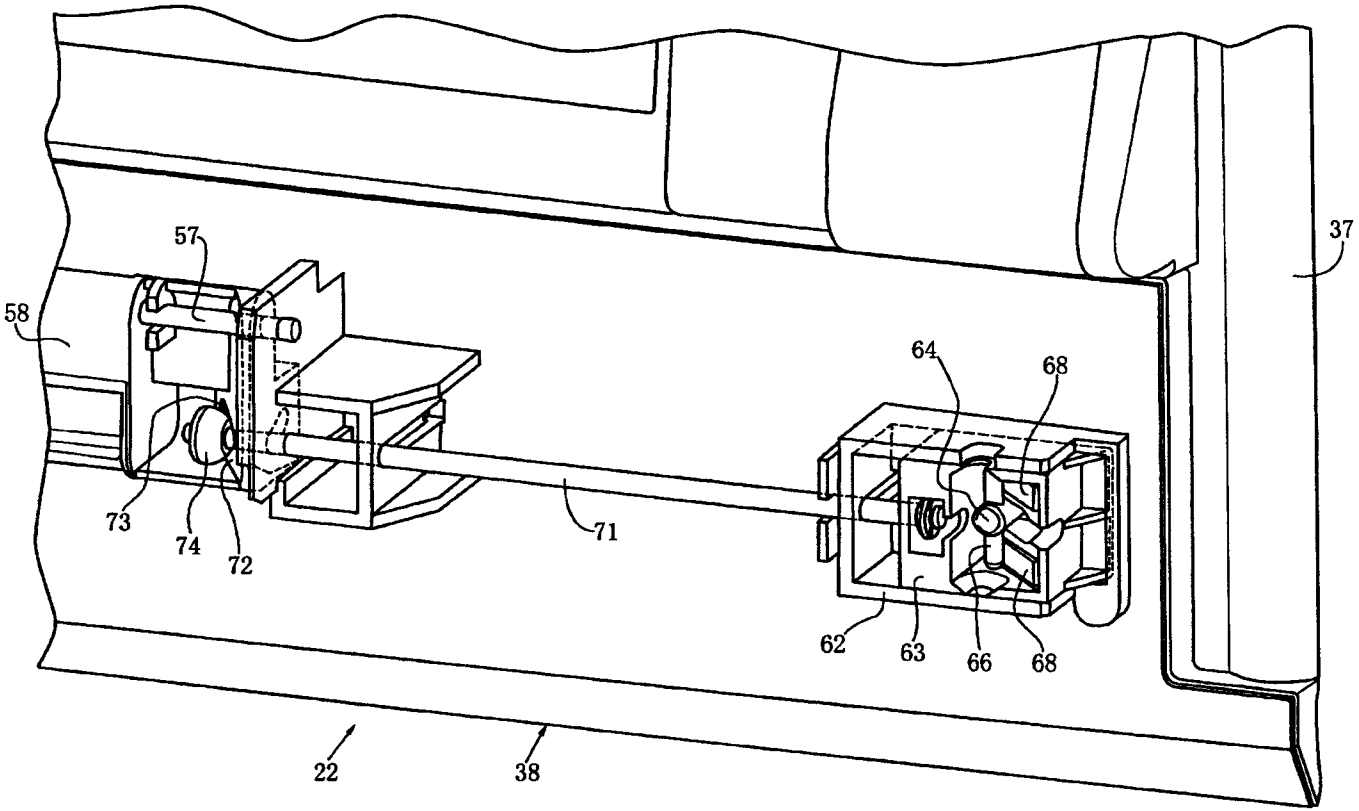
FIG. 12 Perspective view of part of the left and right treatment door of the incubator according to the embodiment of the present invention, in which a frame body cover has been detached.
Figure 13:
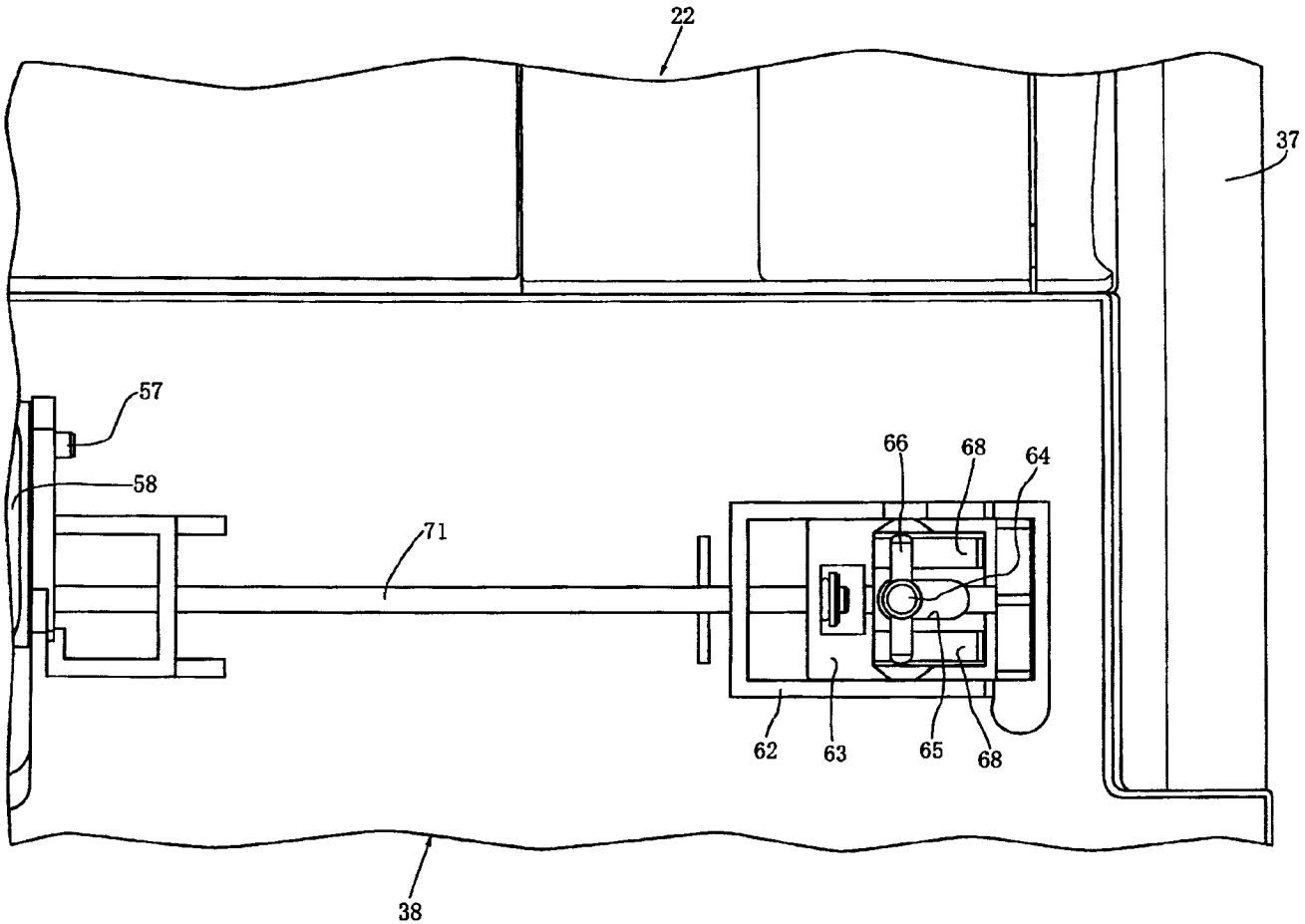
FIG. 13 Front view of part of the left and right treatment door of the incubator according to the embodiment of the present invention, in which the frame body cover has been detached.
Figure 14:
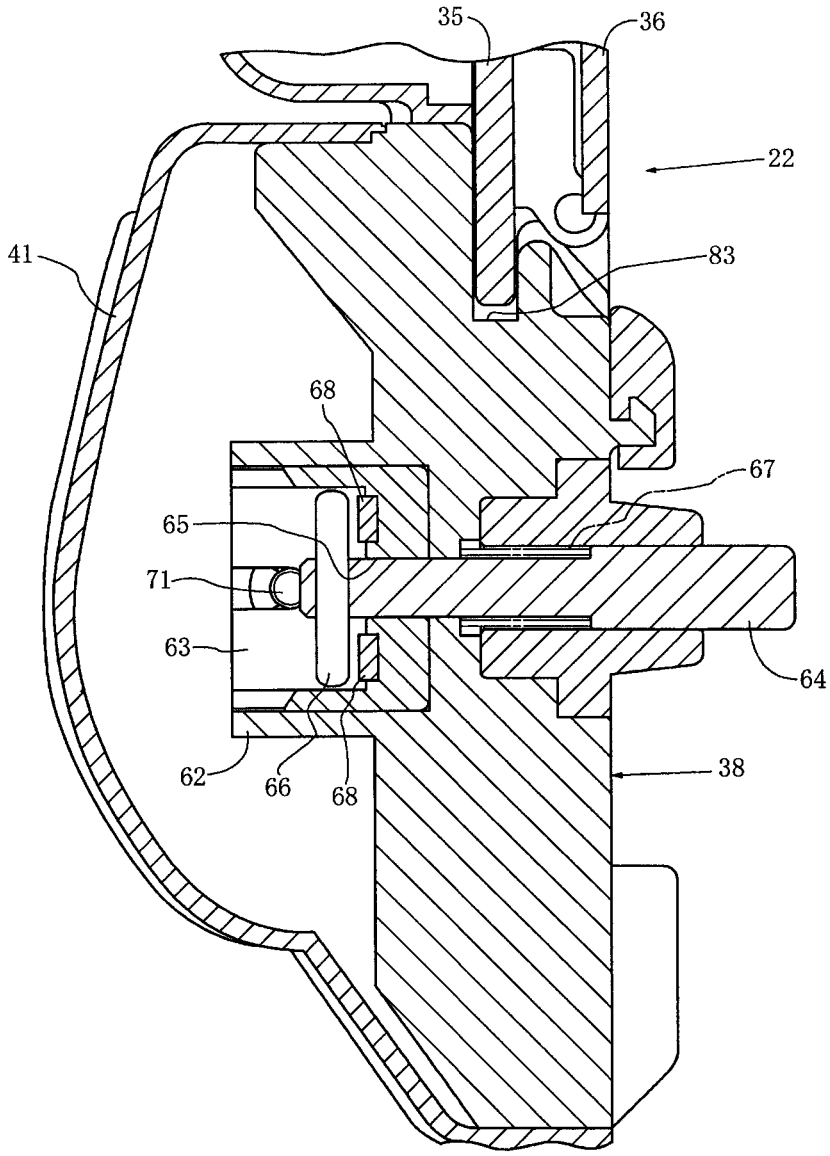
FIG. 14 Longitudinal sectional view of part of the left and right treatment door of the incubator according to the embodiment of the present invention, in which the door has been covered with the frame body cover.

FIGS. 12 to 14 show part of the left and right treatment door 22. Specifically, FIGS. 12 and 13 show a state in which the frame body cover 41 is detached, and FIG. 14 shows a state in which the frame body cover 41 is attached. As shown in FIGS. 12 and 13, a lever 58 is swingably attached to the frame body 38 by a pin 57. As shown in FIGS. 1 to 6, the frame body cover 41 has an opening 61. The lever 58 is located near the opening 61. A treating person can swing the lever 58 by inserting fingers of the person into the frame body cover 41 through the opening 61 and pulling the lever 58 forward. The lever 58 is provided with an urging means (not shown) such as spring, which locates the lever 58 backward in the opening 61 when the lever 58 is not pulled forward.

The frame body 38 has a frame part 62 extending horizontally. A slider 63 is fitted within the frame part 62 so as to be slidable horizontally. A pin 64 is attached to the frame body 38. The basal end of the pin 64 projects into the slider 63 through an elongated hole 65 formed in the slider 63 and elongated in the horizontal direction. Fixed to the basal end of the pin 64 is another pin 66, extending vertically. As shown in FIG. 14, a helical compression spring 67 is interposed between the frame body 38 and the pin 64 so as to urge the pin 64 from the frame body 38 in the direction opposite to the frame body cover 41.

As shown in FIGS. 12 and 13, the slider 63 is provided with a pair of slopes 68 whose height above the frame body 38 increases as the distance from the lever 58 increases. As described above, the helical compression spring 67 urges the pin 64 from the frame body 38 in the direction opposite to the frame body cover 41. Therefore, the peripheries of both ends of the pin 66 fixed to the pin 64 are always in contact with the corresponding slopes 68. The periphery of the pin 66 and the surface of the slopes 68 are formed so as to decrease any friction produced by the contact.

As shown in FIGS. 12 and 13, one end of a connection rod 71 is attached to the slider 63, and, as shown in FIG. 12, the other end of the connection rod 71 is located within the lever 58. The lever 58 is provided with a slope 72 whose distance from the slider 63 increases as the distance from the frame body cover 41 increases. Formed in the slope 72 is an elongated hole 73 elongated in the inclination direction of the slope 72. An approximately hemispherical flange 74 is attached to the other end of the connection rod 71 located in the lever 58.

As described above, the lever 58 is urged backward in the opening 61, and the pin 64 is urged in the direction opposite to the frame body cover 41 from the frame body 38. Accordingly, when the lever 58 is not pulled forward, the pin 66 is located at a part of the slopes 68 of the slider 63 where the distance from the lever 58 is shortest, and the slider 63 is at its furthest location from the lever 58. Consequently, the connection rod 71 is pulled from the lever 58 side toward the slider 63, and the flange 74 of the connection rod 71 is located at a part of the elongated hole 73 of the lever 58 where the distance from the slider 63 is shortest. Additionally, as described above, the pin 66 is located at a part of the slope 68 of the slider 63 where the distance from the lever 58 is shortest and, accordingly, the leading end of the pin 64 projects from the frame body 38 in a direction opposite to the frame body cover 41, as shown in FIG. 14.

When a treating person inserts fingers of the person into the frame body cover 41 through the opening 61 and pulls the lever 58 forward, the flange 74 of the connection rod 71 moves relatively on the slope 72 from a part of the elongated hole 73 of the lever 58 where the distance from the slider 63 is shortest to a part where the distance is longest. With this movement, the connection rod 71 is pulled from the slider 63 side toward the lever 58. Consequently, the slider 63 approaches the lever 58 along the frame part 62, and the pin 66 moves relatively on the slope 68 of the slider 63 from a part of the slope 68 where the distance from the lever 58 is shortest to a part where the distance is longest. As a result, the leading end of the pin 64 gets not to project from the frame body 38 in a direction opposite to the frame body cover 41.

Only one slider 63, only one pin 64, only one connection rod 71, and others are shown in FIGS. 12 and 13. However, there is actually each of these disposed on each of the left and right sides of the lever 58. FIG. 7 shows the state in which the leading ends of the pair of pins 64 project from the frame body 38 in the direction opposite to the frame body cover 41. Additionally, as shown in FIGS. 1 and 2, a constant force spring 75 is engaged with the lower edge of the frame body 38 such that force in the raising direction is applied to the left and right treatment door 22. The force in the raising direction applied by the constant force spring 75 and the self-weight of the left and right treatment door 22 substantially balance.

Figure 15:
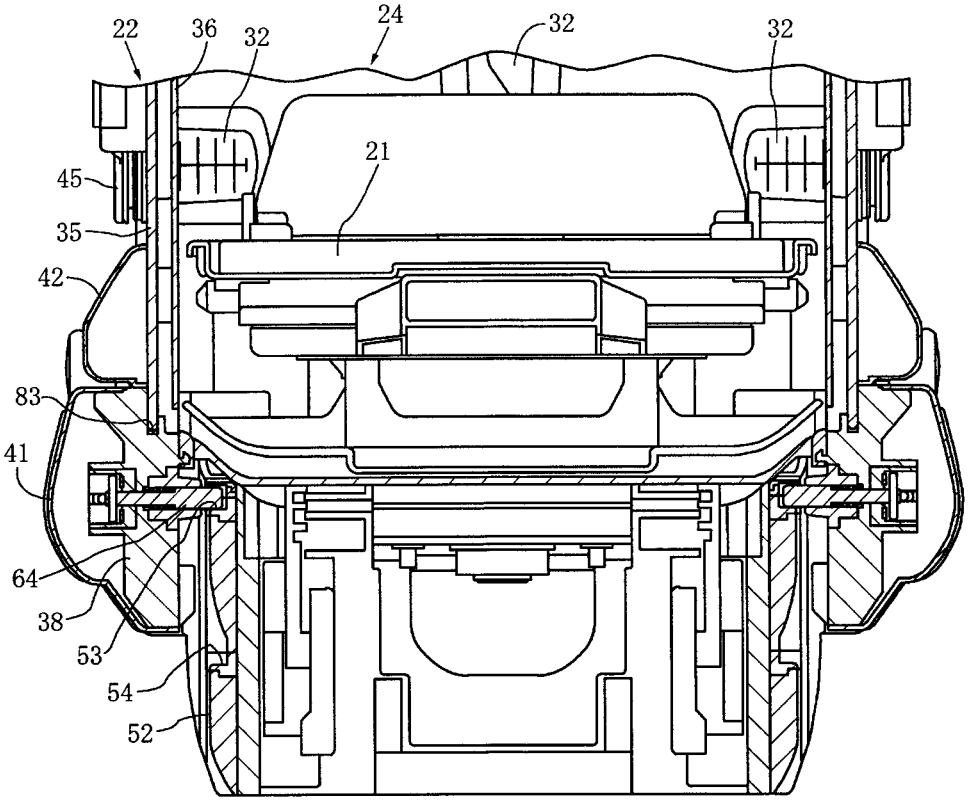
FIG. 15 Longitudinal sectional view of the incubator according to the embodiment of the present invention, illustrating the state in which the left and right treatment door is at its highest position.

In a state in which the left and right treatment door 22 closes the left and right treatment window 33 as shown in FIG. 2, the leading end of the pin 64 projecting from the frame body 38 in the direction opposite to the frame body cover 41 fits in the fitting hole 53 of the base 15, as shown in FIG. 15. The left and right treatment door 22 is prevented from being lowered by the fitting. In order to open the left and right treatment window 33 by lowering the left and right treatment door 22, fingers are inserted into the frame body cover 41 through the opening 61 of the frame body cover 41 and the lever 58 is pulled forward as described above, thereby moving the leading end of the pin 64 backward from the base 15 toward the frame body 38 and releasing the leading end of the pin 64 from the fitting hole 53 of the base 15.

In this released state, when downward force is applied to the left and right treatment door 22 against support of the left and right treatment door 22 by the constant force spring 75, the left and right treatment door 22 starts to lower while the guided rail 37 of the left and right treatment door 22 is guided by the guide groove 51 of the treatment door support 48. However, the door 22 does not lower suddenly by virtue of the action of the constant force spring 75. When the lever 58 is released from operation at the same time as the leading end of the pin 64 is released from the fitting hole 53 of the base 15, the leading end of the pin 64 engages with the engagement groove 52. Then, as the left and right treatment door 22 lowers, this leading end of the pin 64 engages with the slope 55. As the left and right treatment door 22 further lowers, the leading end of the pin 64 fits into the fitting hole 54 of the base 15 as shown in FIG. 16, thereby preventing the left and right treatment door 22 from further lowering.

Figure 16:
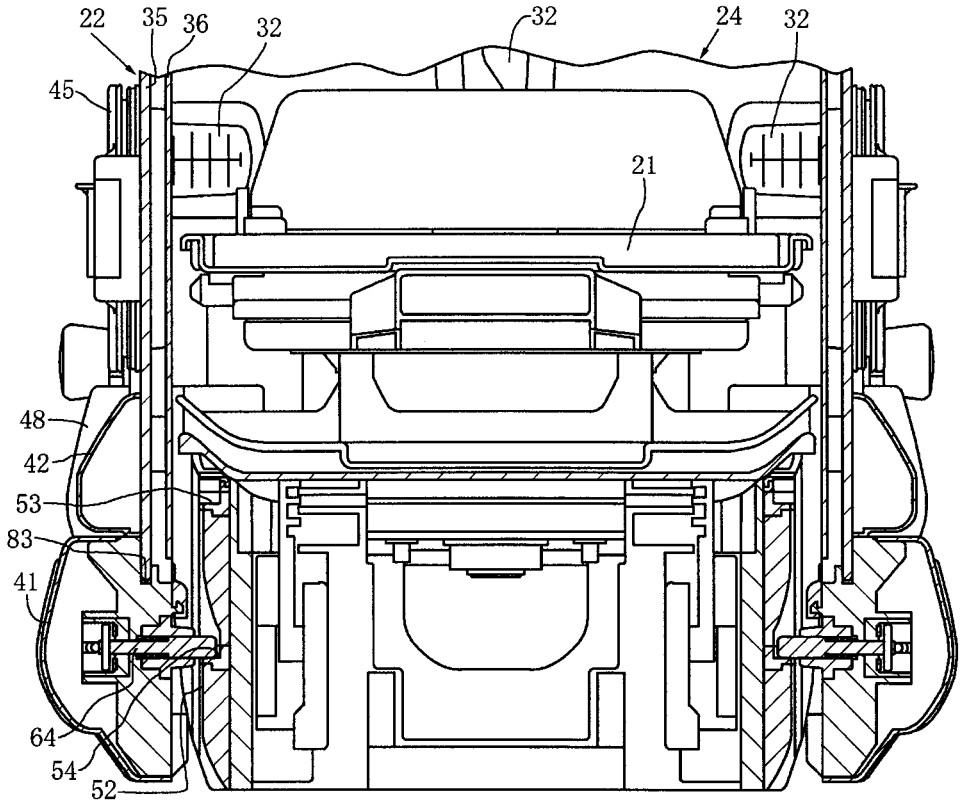
FIG. 16 Longitudinal sectional view of the incubator according to the embodiment of the present invention, illustrating the state in which the left and right treatment door is at its intermediate position.
Figure 17:
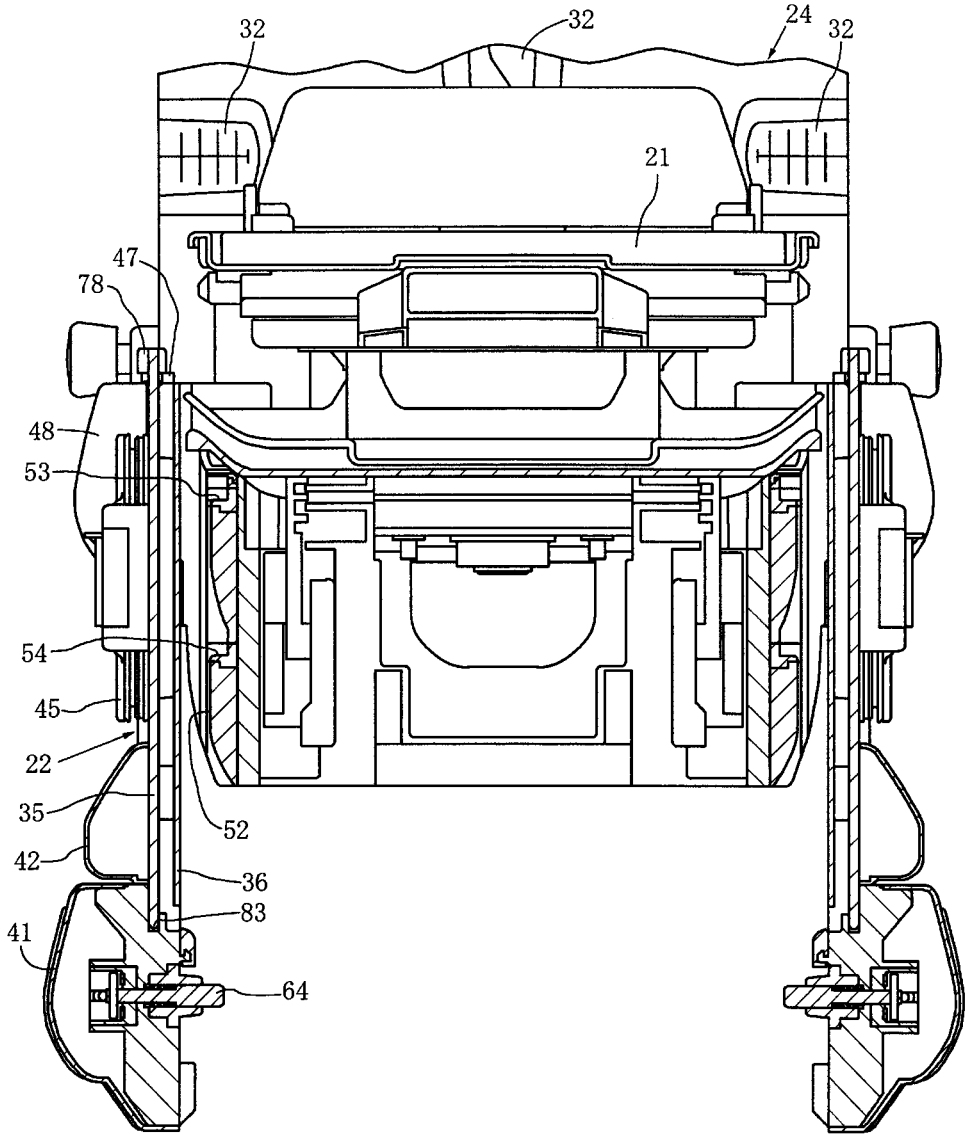
FIG. 17 Longitudinal sectional view of the incubator according to the embodiment of the present invention, illustrating the state in which the left and right treatment door is at its lowest position.

FIG. 16 shows a state in which the left and right treatment door 22 is lowered to its intermediate position, and corresponds to FIG. 4. In the state shown in FIG. 16, when fingers are inserted into the frame body cover 41 through the opening 61 of the frame body cover 41 and the lever 58 is pulled forward again, the left and right treatment door 22 further lowers, and the underside of the stopper 47 comes into contact with the upper face of the treatment door support 48 as shown in FIG. 17, thereby preventing the left and right treatment door 22 from further lowering. FIG. 17 shows a state in which the left and right treatment door 22 is lowered to its lowest position, and corresponds to FIG. 3. If the lever 58 is not released from operation even after the left and right treatment door 22 has been started to lower by pulling the lever 58 forward in the state shown in FIG. 15, the left and right treatment door 22 lowers to its lowest position shown in FIG. 17, without stopping at its intermediate position shown in FIG. 16.

Conversely, in order to raise the left and right treatment door 22 from its lowest position shown in FIG. 17 so as to close the left and right treatment window 33 with the left and right treatment door 22, the left and right treatment door 22 has only to be lifted without pulling the lever 58 forward. In this case also, the left and right treatment door 22 can be lifted with comparatively less force by virtue of the action of the constant force spring 75. When the left and right treatment door 22 starts to rise, the leading end of the pin 64 smoothly engages with the engagement groove 52 by virtue of the slope 56 without pulling the lever 58 forward. Consequently, the leading end of the pin 64 fits into the fitting hole 54. When the left and right treatment door 22 is stopped being lifted in this state, the left and right treatment door 22 stops at its intermediate position shown in FIG. 16.

If the left and right treatment door 22 is not stopped being lifted even after the leading end of the pin 64 has been fitted into the fitting hole 54, the leading end of the pin 64 passes on the slope 55 and engagement groove 52 and fits into the fitting hole 53. Consequently, the left and right treatment door 22 stops at its highest position shown in FIG. 15. When the left and right treatment door 22 is lifted, the leading end of the pin 64 smoothly escapes from the fitting hole 54 by virtue of the slope 55 without pulling the lever 58 forward even after the leading end of the pin 64 has been fitted into the fitting hole 54. Thus, the leading end engages with the engagement groove 52.

(3) Rotation of the Left and Right Treatment Door

As shown in FIG. 6, notches 76 are formed in the upper ends of the both side edges of the outer wall 35 of the left and right treatment door 22. Additional notches 77 are also formed below the notches 76. Mounted on the stopper 47 and the upper end of the guided rail 37 is a knob 78 which can fit into the notch 76 from above and can rotate. Mounted in the vicinity of the upper end of the guided rail 37 is a hook 81 which supports the outer wall 35 and others by engaging with the notch 77. Also, mounted in the vicinity of the upper edge of the outer wall 35 is a handle 82 used to lift the outer wall 35, inner wall 36, and others.

Figure 18:
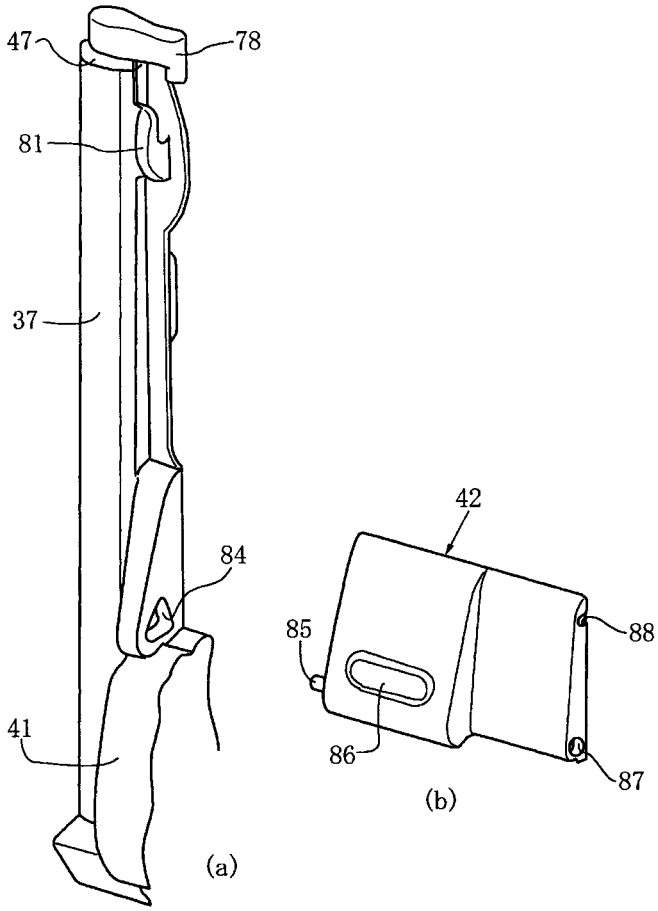
FIG. 18 Perspective view of part of the left and right treatment door of the incubator according to the embodiment of the present invention, (a) and (b) showing a guided rail and a hinge, respectively.

As shown in FIGS. 15 to 17, the frame body 38 has a fitting groove 83 for the outer wall 35. In the state in which the notch 77 engages with the hook 81, the lower edge of the outer wall 35 fits in the fitting groove 83. As shown in FIG. 18(*a*), an approximately triangular recess 84 is formed at part adjacent to the hinge 42 of the guided rail 37. As shown in FIG. 18(*b*), the hinge 42 has a rotation shaft 85 which is disposed in the recess 84. In addition, the hinge 42 includes: a projection 86 for contact; a bearing hole 87 in which the rotation shaft (not shown) of the X-ray cassette door 43 is inserted; and a recess 88 into which a rotation preventing shaft (not shown) of the X-ray cassette door 43 fits.

In order to rotate the outer wall 35, inner wall 36, and others of the left and right treatment door 22, the knobs 78 are first rotated to release the knobs 78 from the notches 76 of the outer wall 35. Next, the outer wall 35, inner wall 36, hinge 42, and X-ray cassette door 43 are lifted using the handle 82. Thereby, the lower edge of the outer wall 35 is released from the fitting groove 83 and, at the same time, the notches 77 of the outer wall 35 is released from the hooks 81. At this time, the rotation shaft 85 of the hinge 42 moves within the recess 84 of the guided rail 37 and, accordingly, the outer wall 35, inner wall 36, and others are lifted as described above.

Figure 19:
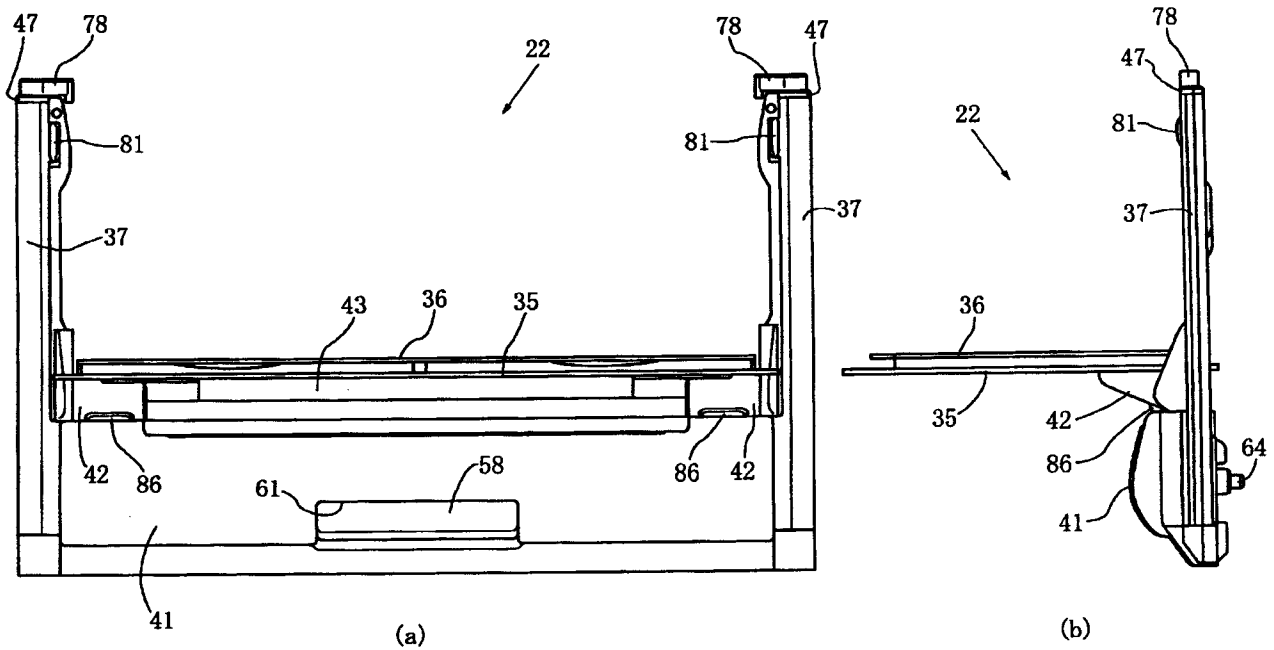
FIG. 19 Drawing illustrating the left and right treatment door in the state in which the outer wall, inner wall, and others of the incubator according to the embodiment of the present invention have been rotated, (a) and (b) being a front view and a side view thereof, respectively.

As the outer wall 35, inner wall 36, and others are rotated forward, the projection 86 of the hinge 42 comes into contact with the upper face of the frame body cover 41, thereby stopping this rotation, as shown in FIG. 19. In this state, the outer wall 35, inner wall 36, and others have been rotated up to 90° and been at an approximately horizontal position such that the inner surface of the inner wall 36 faces up. The face-up state allows a person to wipe the inner surface of the inner wall 36 or others in a comfortable position, thus making it easy to keep the inside of the incubator 11 clean. Incidentally, as shown in FIG. 19, during this rotation, the guided rail 37, frame body 38, and frame body cover 41 are not rotated.

In order to rotate the outer wall 35, inner wall 36, and others, it is necessary to lift them as described above. Therefore, when the left and right treatment door 22 is at its highest position, the canopy 27 has to be raised as shown in FIG. 5. In a case where the left and right treatment door 22 is at its lowest position, the outer surface of the outer wall 35 comes into contact with the treatment door support 48 when the outer wall 35, inner wall 35, and others are rotated, thus making it impossible for them to rotate. In the incubator 11 according to the present embodiment, the outer wall 35, inner wall 36, and others rotate only to a maximum of 90° as described above, but this limit could be other than 90°, for example, 180° so that the inner surface of the inner wall 36 faces outward.

(4) Raising and Lowering of the Foot End Treatment Door

Figure 20:
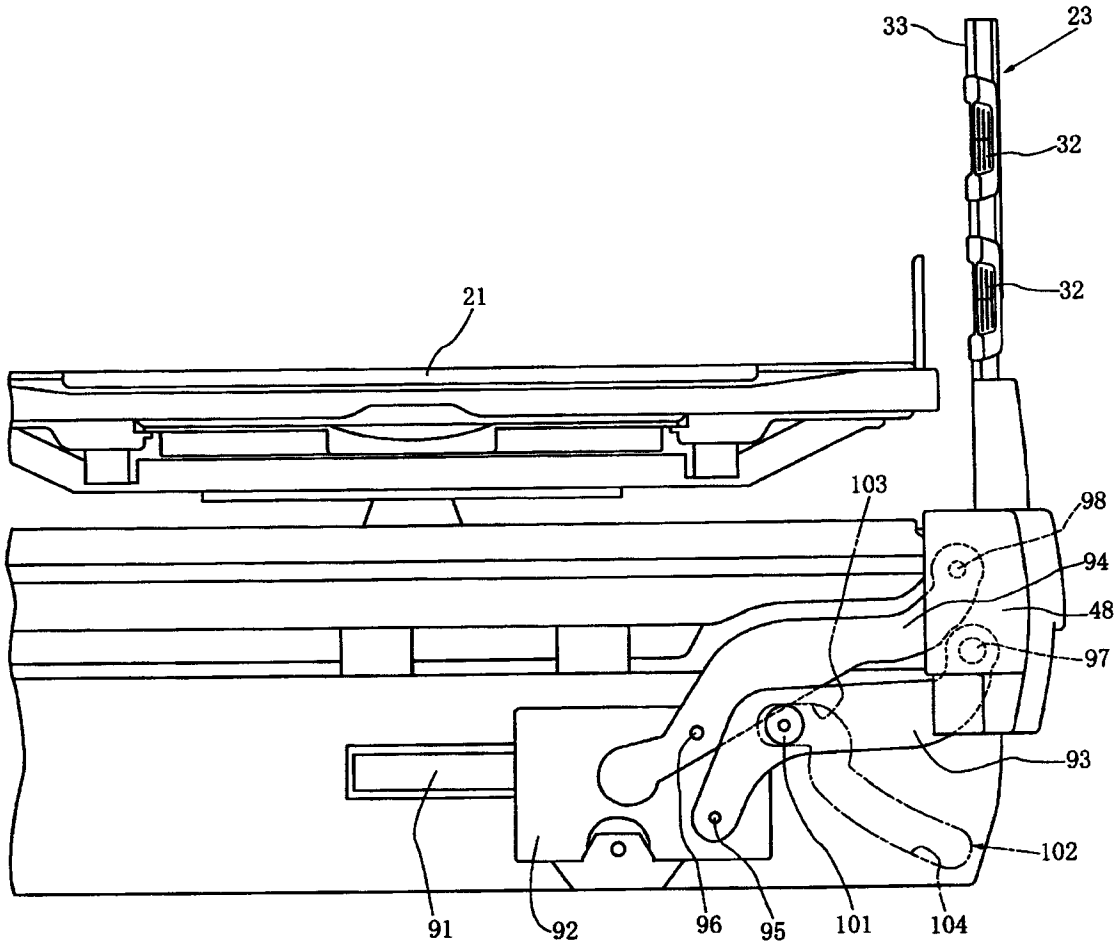
FIG. 20 Side view of part of the incubator according to the embodiment of the present invention as viewed from the left and right treatment door side, illustrating the state in which the left and right treatment door has been detached and the foot end treatment door is at its highest position.
Figure 21:
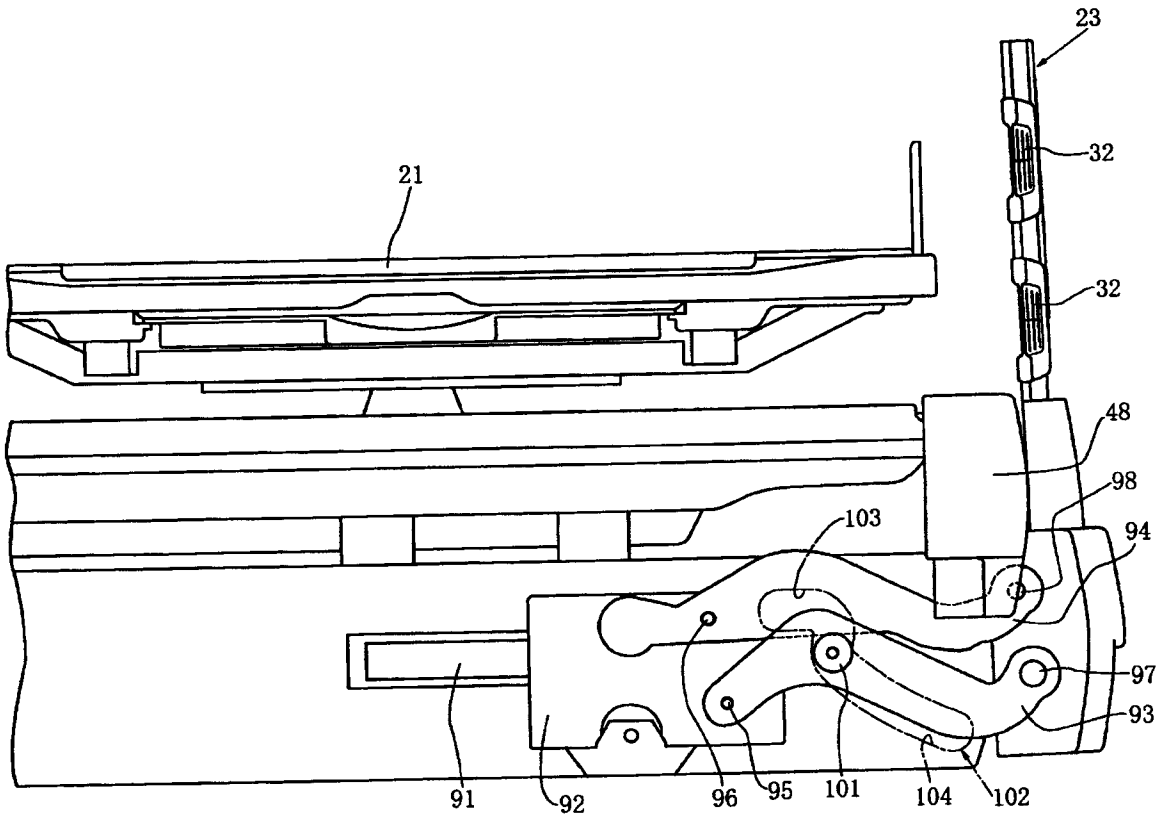
FIG. 21 Side view of part of the incubator according to the embodiment of the present invention as viewed from the left and right treatment door side, illustrating the state in which the left and right treatment door has been detached and the foot end treatment door is at its intermediate position.
Figure 22:
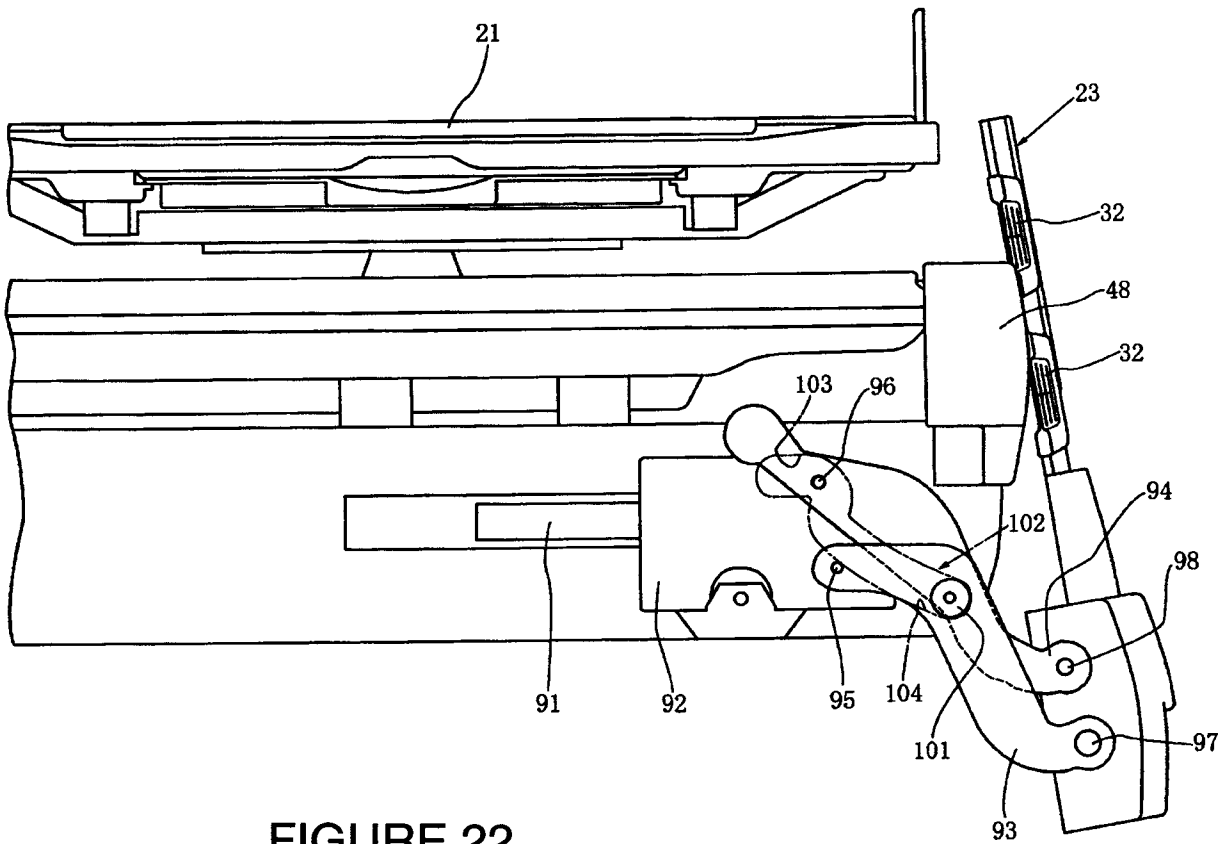
FIG. 22 Side view of part of the incubator according to the embodiment of the present invention as viewed from the left and right treatment door side, illustrating the state in which the left and right treatment door has been detached and the foot end treatment door is at its lowest position.

As shown in FIGS. 20 to 22, disposed in the base 15 are: a guide rail 91 extending horizontally parallel to the frame body 38 of the left and right treatment door 22; and a movable body 92 movable by being guided by the guide rail 91. Basal-end attaching parts 95 and 96 of a pair of links 93 and 94 are mounted on the movable body 92 so as to be rotatable. Leading-end attaching parts 97 and 98 of this pair of links 93 and 94 are mounted in the vicinity of the lower end of the foot end treatment door 23 so as to be rotatable.

The interval between the basal-end attaching part 95 and the leading-end attaching part 97 equals that between the basal-end attaching part 96 and the leading-end attaching part 98. However, the interval between the leading-end attaching parts 97 and 98 is narrower than that between the basal-end attaching parts 95 and 96. A roller 101 is attached to the link 93, and a guide groove 102 is formed in the base 15 in order to guide the roller 101 while rotating it. The guide groove 102 includes: a horizontal part 103 extending horizontally with approaching the foot end treatment door 23 from the area farthest from the foot end treatment door 23; and an inclined part 104 approaching the foot end treatment door 23 with moving downwards thereafter.

While the roller 101 rotates within the horizontal part 103 of the guide groove 102, the movable body 92 only moves along the guide rail 91, and there is no change in the relative location between the links 93 and 94, that is, between the basal-end attaching parts 95 and 96 and the leading-end attaching parts 97 and 98. However, while the roller 101 is rotating within the inclined part 104 of the guide groove 102, not only does the movable body 92 move along the guide rail 91, but also the link 93 rotates about the basal-end attaching part 95. Additionally, since both leading-end attaching parts 97 and 98 are attached to the foot end treatment door 23, the link 94 also rotates about the basal-end attaching part 96.

As described above, the interval between the basal-end attaching part 95 and the leading-end attaching part 97 equals that between the basal-end attaching part 96 and the leading-end attaching part 98, but the interval between the leading-end attaching parts 97 and 98 is narrower than that between the basal-end attaching parts 95 and 96. Therefore, a shape defined by the basal-end attaching parts 95 and 96 together with the leading-end attaching parts 97 and 98 is not a parallelogram. If the interval between the leading-end attaching parts 97 and 98 and the interval between the basal-end attaching parts 95 and 96 are equal and the shape defined by the basal-end attaching parts 95 and 96 and the leading-end attaching parts 97 and 98 is a parallelogram, a straight line connecting the basal-end attaching parts 95 and 96 and a straight line connecting the leading-end attaching parts 97 and 98 remain parallel to each other even when the links 93 and 94 rotate about the basal-end attaching parts 95 and 96 respectively.

However, the shape is not a parallelogram. Therefore, in order to maintain the interval between the leading-end attaching parts 97 and 98 mounted on the foot end treatment door 23, the straight line connecting the leading-end attaching parts 97 and 98 is inclined as described below. That is, as shown in FIGS. 20 to 22, as the roller 101 moves downwards within the inclined part 104 of the guide groove 102, the leading-end attaching part 98 on the straight line connecting the leading-end attaching parts 97 and 98 approaches the straight line connecting the basal-end attaching parts 95 and 96. Conversely, as the roller 101 moves upwards within the inclined part 104 of the guide groove 102, the straight line connecting the leading-end attaching parts 97 and 98 is inclined such that the leading-end attaching part 98 on the straight line connecting the leading-end attaching parts 97 and 98 moves away from the straight line connecting the basal-end attaching parts 95 and 96.

In FIGS. 20 to 22, only the links 93 and 94 and others of one of the pair of left and right treatment doors 22 are shown. However, the base 15 has, on the side corresponding to the other one of the pair of doors 22, links 93 and 94 and others disposed symmetrically in left and right with those shown in FIGS. 20 to 22. That is, the links 93 and 94 are attached to each of the left and right ends of the foot end treatment door 23 by means of the leading-end attaching parts 97 and 98.

Figure 23:
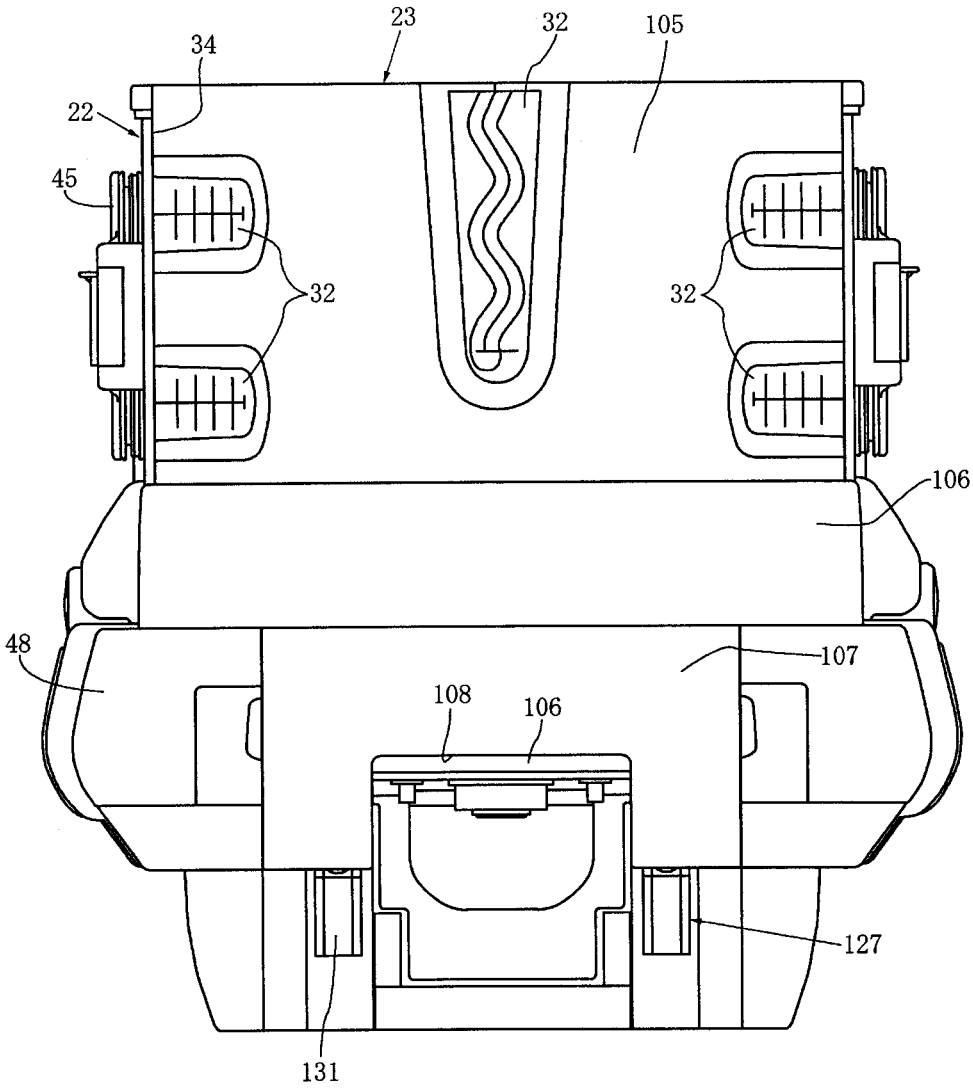
FIG. 23 Side view of the incubator according to the embodiment of the present invention as viewed from the foot end treatment door side, illustrating the state in which the foot end treatment door is at its highest position.
Figure 24:
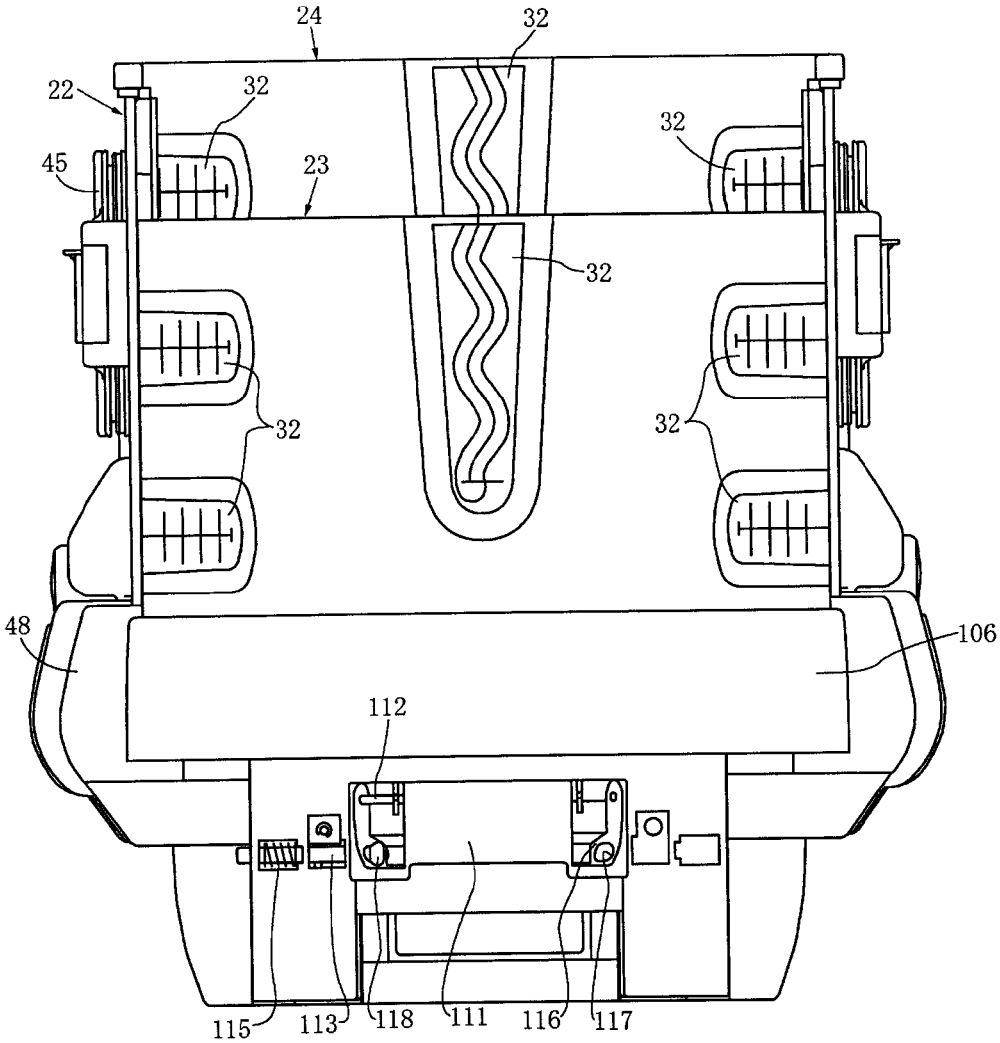
FIG. 24 Side view of the incubator according to the embodiment of the present invention as viewed from the foot end treatment door side, illustrating the state in which a frame body cover of the foot end treatment door has been detached and the foot end treatment door is at its intermediate position.
Figure 25:
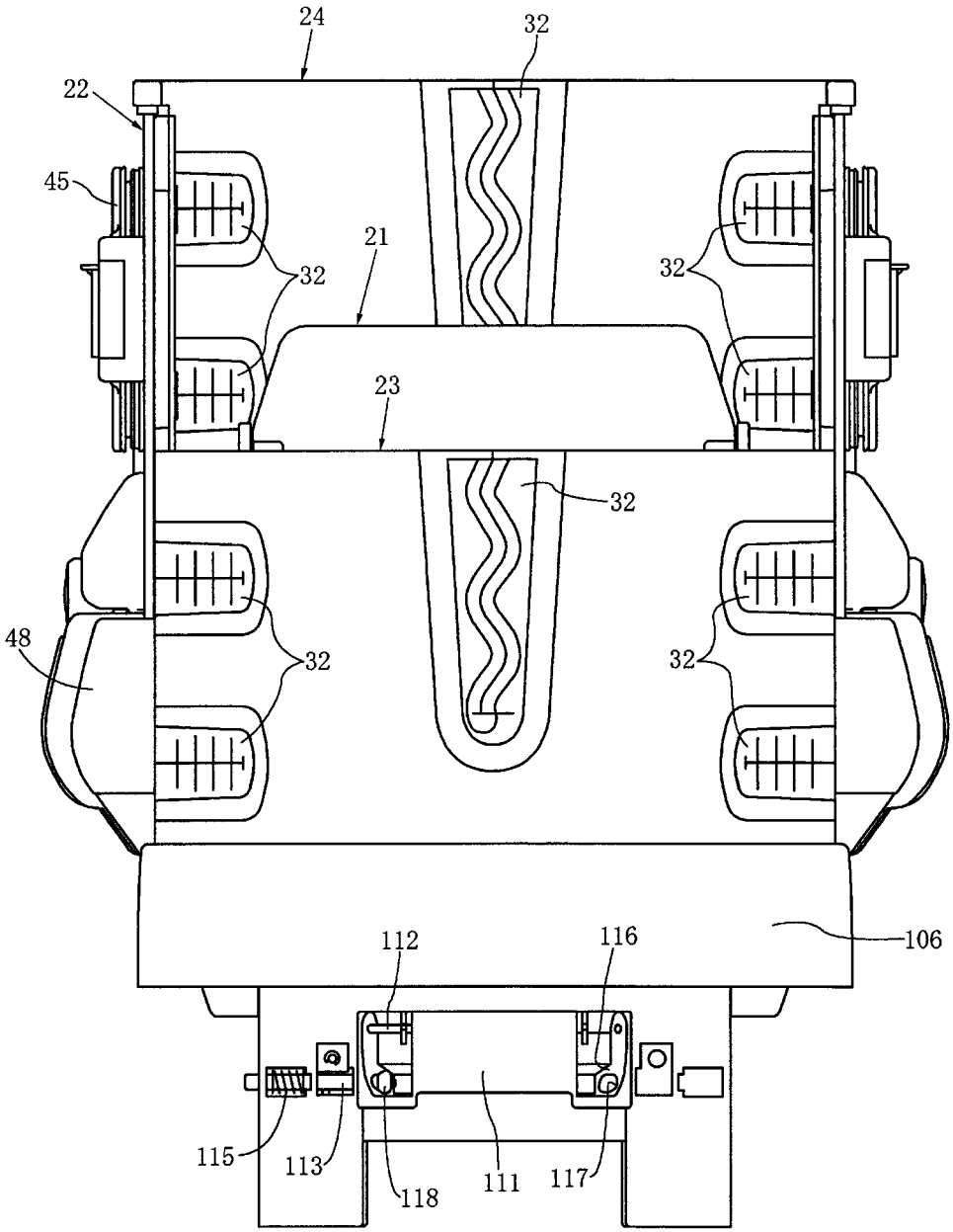
FIG. 25 Side view of the incubator according to the embodiment of the present invention as viewed from the foot end treatment door side, illustrating the state in which the frame body cover of the foot end treatment door has been detached and the foot end treatment door is at its lowest position.

On the other hand, as shown in FIGS. 23 to 25, the foot end treatment door 23 has a transparent wall 105, a frame body 106, a frame body cover 107, and others. The frame body cover 107 covers only part of the frame body 106 and has a notch 108. FIGS. 24 and 25 show the foot end treatment door 23 from which the frame body cover 107 is detached. A lever 111 similar to the lever 58 in the left and right treatment door 22 is attached to the frame body 106.

The lever 111 is located in the vicinity of the notch 108, and can swing about a pair of pins 112 relative to the frame body 106. A treating person can swing the lever 111 by inserting fingers of the person into the frame body cover 107 through the notch 108 and pulling the lever 111 forward. The lever 111 is provided with an urging means (not shown), such as a spring, which locates the lever 111 backward in the notch 108 when the lever 111 is not pulled forward.

A pair of pins 113 is attached to the frame body 106.

One end of each of these pins 113 is located in the lever 111. In FIGS. 24 and 25, the pins 112 and 113 on the right side are not shown. An E-ring 114 (FIG. 26) is attached to the intermediate part of the pin 113, and a helical compression spring 115 (FIG. 26) is interposed between the E-ring 114 and the frame body 106. Accordingly, the helical compression spring 115 urges the pin 113 from the lever 111 side toward the treatment door support 48.

Figure 27:
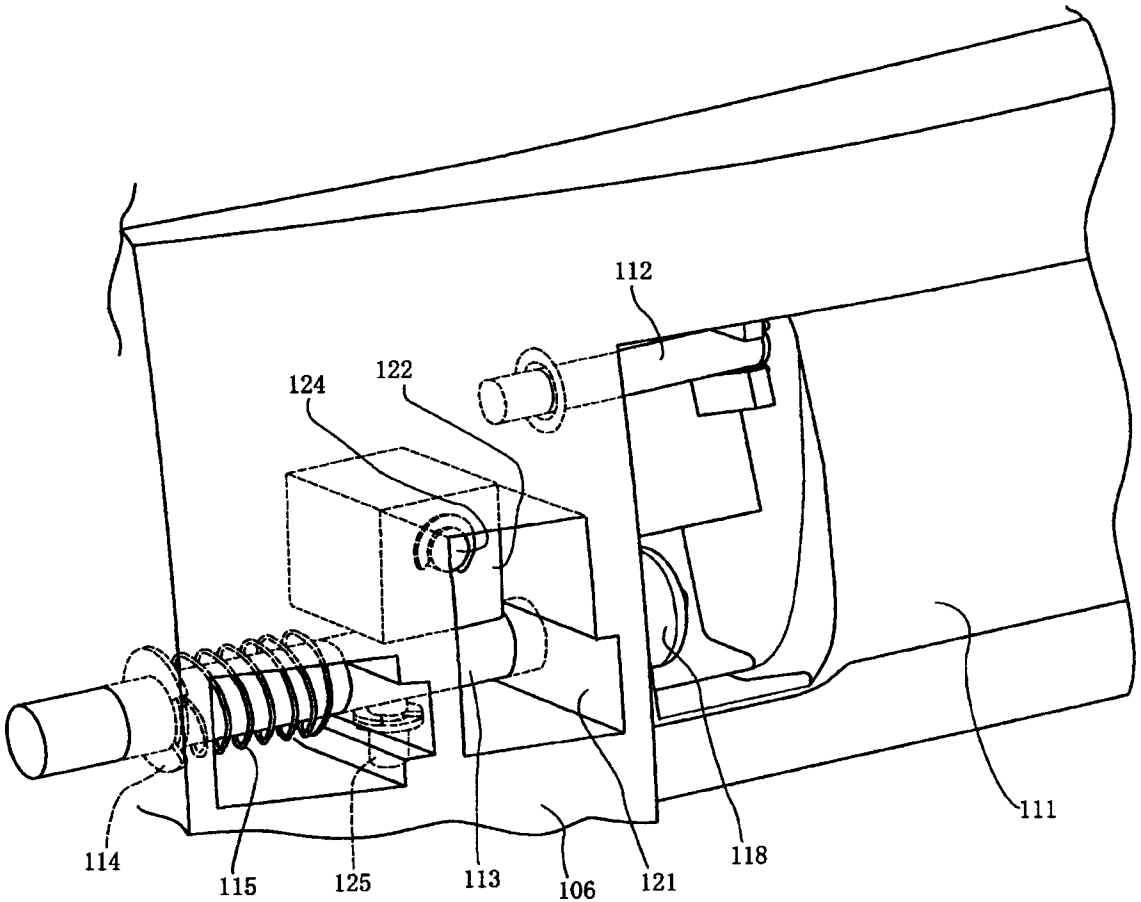
FIG. 27 Perspective view of part of the foot end treatment door of the incubator according to the embodiment of the present invention, illustrating the state in which the frame body cover of the foot end treatment door has been detached.
Figure 28:
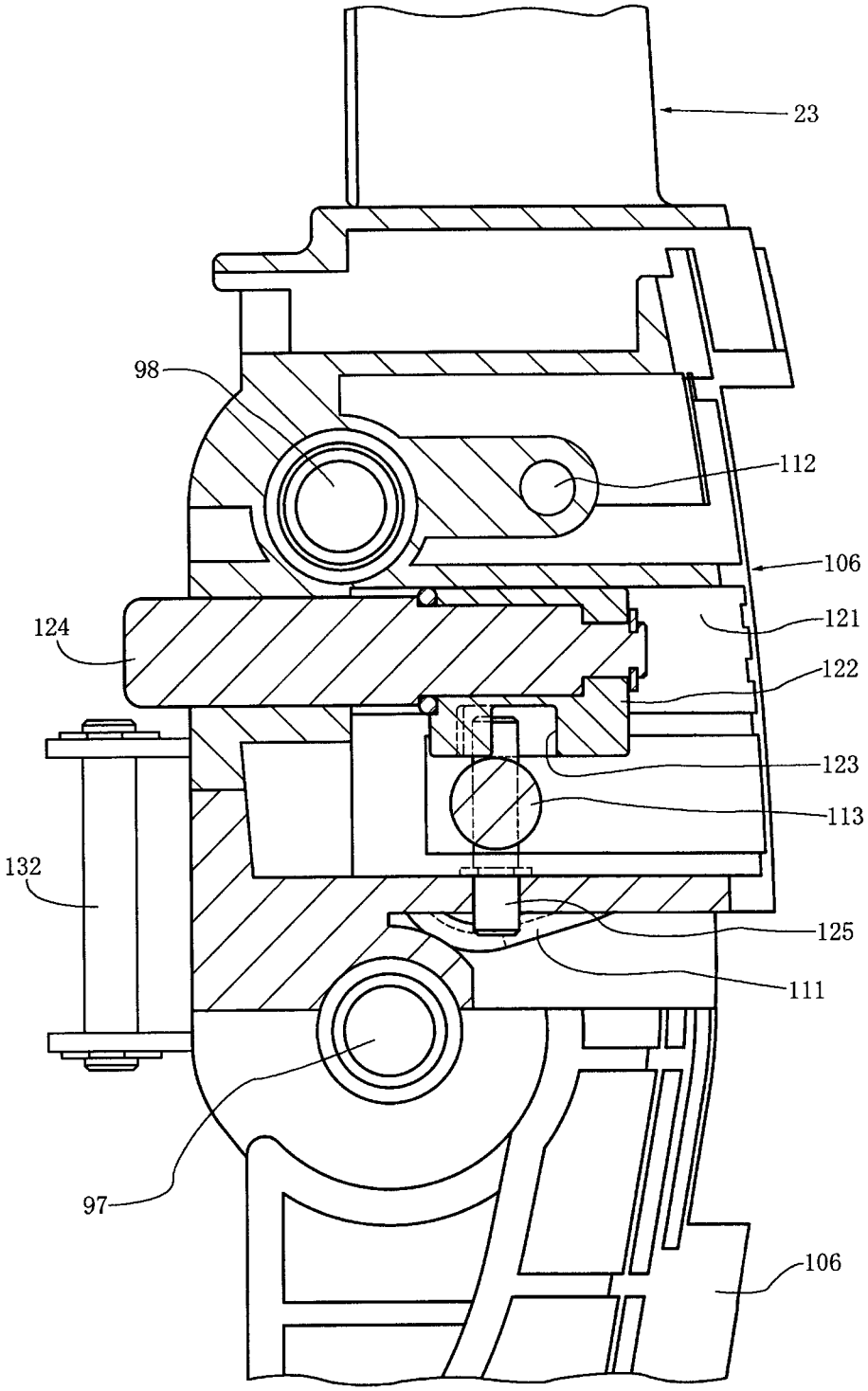
FIG. 28 Longitudinal sectional view of part of the foot end treatment door of the incubator according to the embodiment of the present invention.

The lever 111 is provided with a slope 116 whose distance from the treatment door support 48 increases as the distance from the frame body cover 107 increases. Formed in the slope 116 is an elongated hole 117 elongated in the inclination direction of the slope 116. An approximately hemispherical flange 118 is attached to one end of the pin 113 located in the lever 111. As described above, the lever 111 is urged backward in the notch 108 and the pin 113 is urged from the lever 111 side toward the treatment door support 48. As shown in FIGS. 27 and 28, recesses 121 are formed in the frame body 106 and on both sides of the lever 111, and a movable body 122 is disposed in each of the recesses 121 and on the pin 113.

Figure 29:
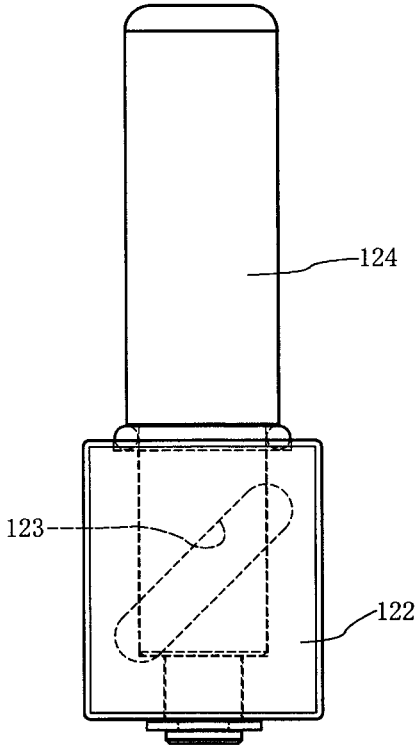
FIG. 29 Plan view of a movable body in the foot end treatment door of the incubator according to the embodiment of the present invention.

As shown in FIGS. 28 and 29, formed in the bottom of the movable body 122 is an engagement groove 123 that obliquely intersects the axial direction of the pin 113 so that the distance from the frame body cover 107 increases as the distance from the lever 111 decreases. Additionally, as shown in FIGS. 27 and 28, fixed to the movable body 122 is a pin 124 extending in the thickness direction of the foot end treatment door 23. The leading end of the pin 124 is always kept projecting from the foot end treatment door 23 toward the base 15.

Figure 26:
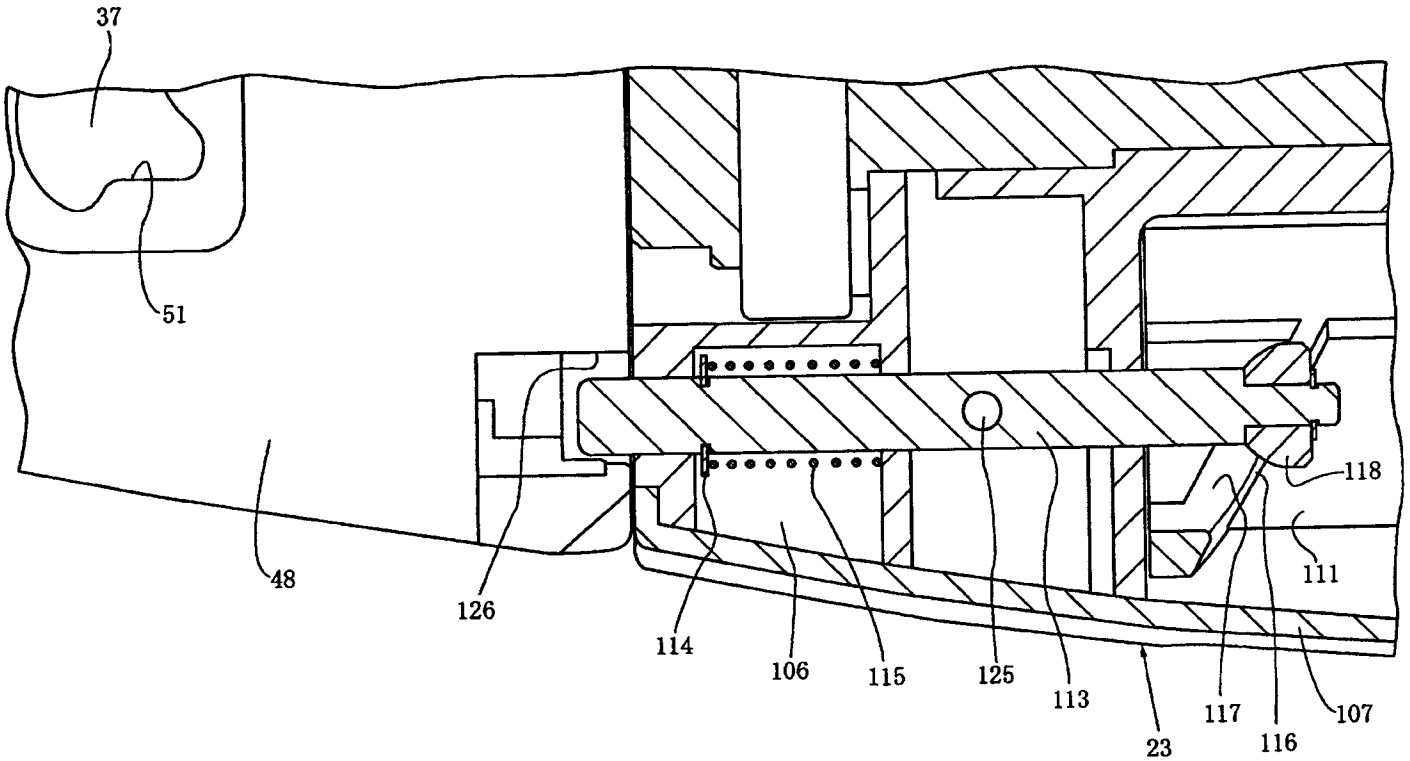
FIG. 26 Transverse sectional view of parts of the foot end treatment door and treatment door support of the incubator according to the embodiment of the present invention.

As shown in FIG. 26, another pin 125 is fixed to the pin 113 so as to extend through the pin 113 along the diameter of the pin 113. As shown in FIG. 28, the upper end of the pin 125 engages with the engagement groove 123 of the movable body 122. Accordingly, as the pin 113 moves along the frame body cover 107, the movable body 122 moves within the recess 121 in a direction substantially perpendicular to the frame body cover 107. Hence, the pin 124 also moves in a direction substantially perpendicular to the frame body cover 107.

When the lever 111 is not pulled forward, the pin 113 is pulled from the lever 111 side toward the treatment door support 48. Consequently, the flange 118 of the pin 113 is located in the elongated hole 117 of the lever 111 where the distance of the flange 118 from the treatment door support 48 is shortest. In addition, the pin 125 engages with the engagement groove 123 where the distance of the pin 125 from the lever 111 is longest, that is, where the distance of the pin 125 from the frame body cover 107 is shortest. As a result, the other end of the pin 113 projects from the frame body 106 toward the treatment door support 48 as shown in FIGS. 24 to 26, and the degree of projection of the pin 124 from the foot end treatment door 23 toward the base 15 increases.

When a treating person inserts fingers of the person into the frame body cover 107 through the notch 108 and pulls the lever 111 forward, the flange 118 of the pin 113 moves relatively on the slope 116 from a part of the elongated hole 117 of the lever 111 where the distance from the left and right treatment door 22 is shortest to a part where the distance is longest. With this movement, the pin 113 is pulled from the treatment door support 48 side toward the lever 111. Additionally, the pin 125 engages with the engagement groove 123 where the distance from the lever 111 is shortest, that is, where the distance from the frame body cover 107 is longest. Consequently, the other end of the pin 113 does not project from the frame body 106 toward the treatment door support 48, and the degree of projection of the pin 124 from the foot end treatment door 23 toward the base 15 decreases.

FIG. 26 shows the foot end treatment door 23 and the treatment door support 48 in a state in which the foot end treatment door 23 has closed the foot end treatment window 34. As shown in FIG. 26, a recess 126 for accommodating the other end of the pin 113 is formed in a vertical face, into which the foot end treatment door 23 fits, of the treatment door support 48.

Figure 30:
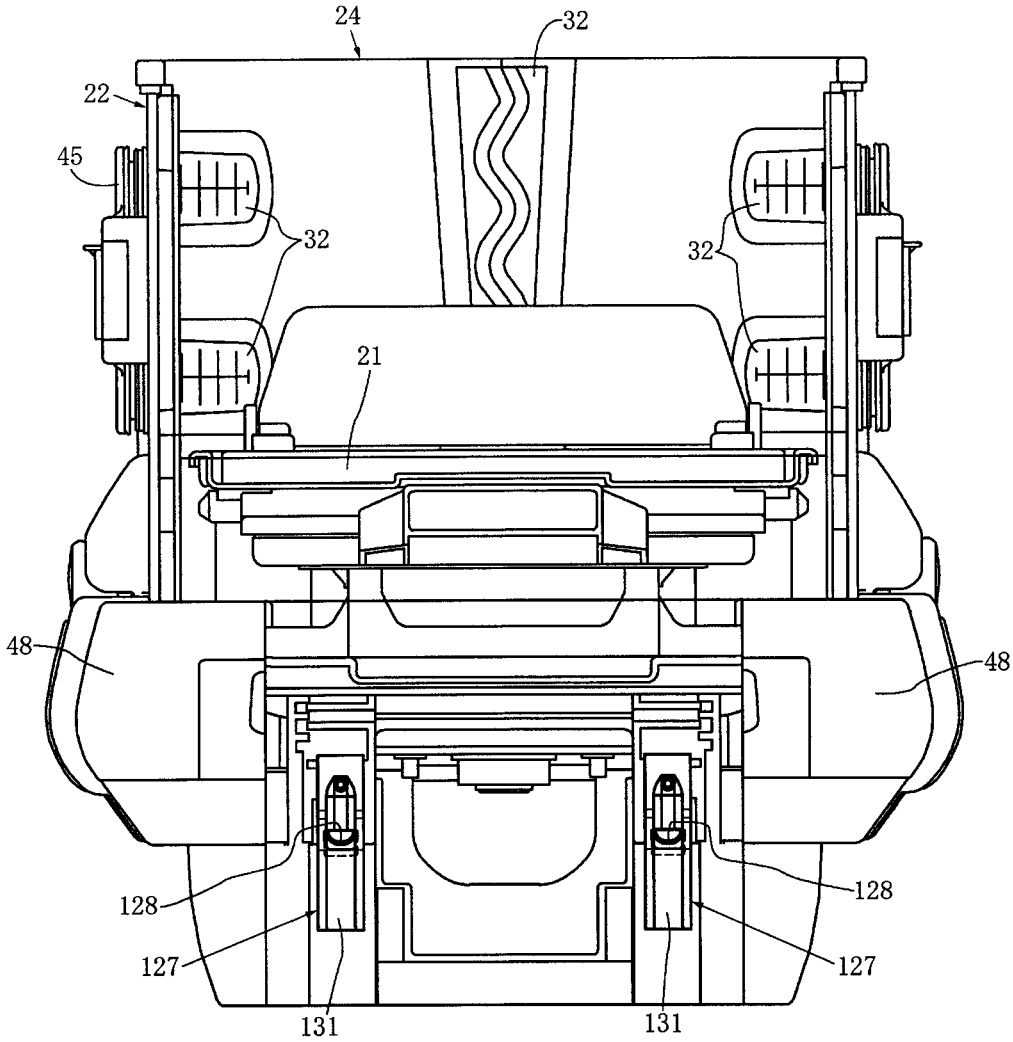
FIG. 30 Side view of the incubator according to the embodiment of the present invention as viewed from the foot end treatment door side, illustrating the state in which the foot end treatment door has been detached.

Additionally, as shown in FIG. 30, a pair of engagement grooves 127 extending vertically and capable of engaging with the pin 124 is formed in the vicinity of the treatment door support 48 in the side of the base 15 that is opposite to the foot end treatment door 23 when the foot end treatment door 23 is raised or lowered. On the upper edge of each engagement groove 127, formed is a fitting part 128 deeper than the engagement groove 127. The fitting part 128 is open at the top. Further, a slope 131 is formed in the engagement groove 127 such that from the fitting part 128 to the lower edge of the engagement groove 127 the engagement groove 127 gradually becomes deeper.

Accordingly, when the foot end treatment door 23 closes the foot end treatment window 34 as shown in FIGS. 20 and 23, the other end of the pin 113 engages with the recess 126 of the treatment door support 48 as shown in FIG. 26, thus preventing the foot end treatment door 23 from lowering. In order to lower the foot end treatment door 23 from the closing state as shown in FIGS. 20 and 23 to its intermediate position as shown in FIGS. 21 and 24, the lever 111 is pulled forward, and the other end of the pin 113 and the recess 126 of the treatment door support 48 are disengaged mutually.

If the lever 111 has not been pulled forward when the foot end treatment door 23 has been lowered to its intermediate position shown in FIGS. 21 and 24, the leading end of the pin 124 fits into the fitting part 128 of the engagement groove 127 from above, thus preventing the foot end treatment door 23 from lowering further. If the leading end of the pin 124 and the fitting part 128 are disengaged by pulling the lever 111 forward again, with the foot end treatment door 23 lowered to its intermediate position as shown in FIGS. 21 and 24, or if the lever 111 remains pulled forward even when the door 23 has been lowered down to this intermediate position, the leading end of the pin 124 slides on the slope 131. Consequently, the foot end treatment door 23 lowers further to its lowest position and opens the foot end treatment window 34, as shown in FIGS. 22 and 25.

Conversely, to raise the foot end treatment door 23 from its lowest position shown in FIGS. 22 and 25, the door 23 has only to be lifted without pulling the lever 111 forward. In this case, if lifting the foot end treatment door 23 is discontinued at its intermediate position shown in FIGS. 21 and 24, the leading end of the pin 124 fits into the fitting part 128 of the engagement groove 127 at this intermediate position and hence the foot end treatment door 23 stops. If the lifting of the foot end treatment door 23 is continued even at this intermediate position, the leading end of the pin 124 escapes upward from the fitting part 128 since the fitting part 128 is open at the top as described above. Consequently, the foot end treatment door 23 rises to its highest position shown in FIGS. 20 and 23, with the result that urge from the helical compression spring 115 causes the other end of the pin 113 to engage with the recess 126 of the treatment door support 48.

(5) Restriction of Lowering of the Foot End Treatment Door

Figure 31:
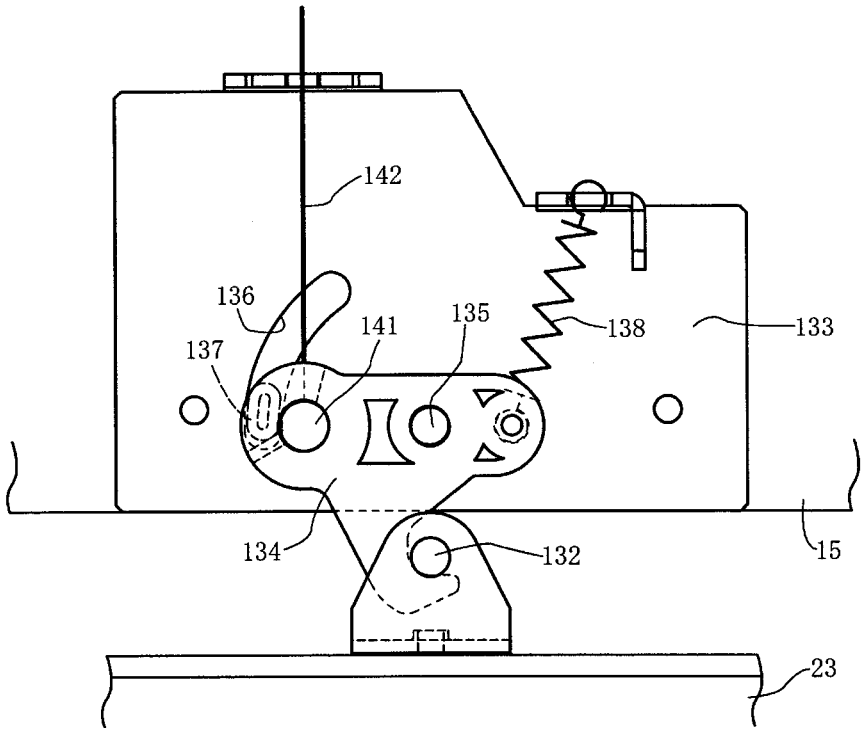
FIG. 31 Plan view of a latch of the base and a latch receiver of the foot end treatment door in the incubator according to the embodiment of the present invention, illustrating the state in which the latch and the latch receiver engage mutually.
Figure 32:
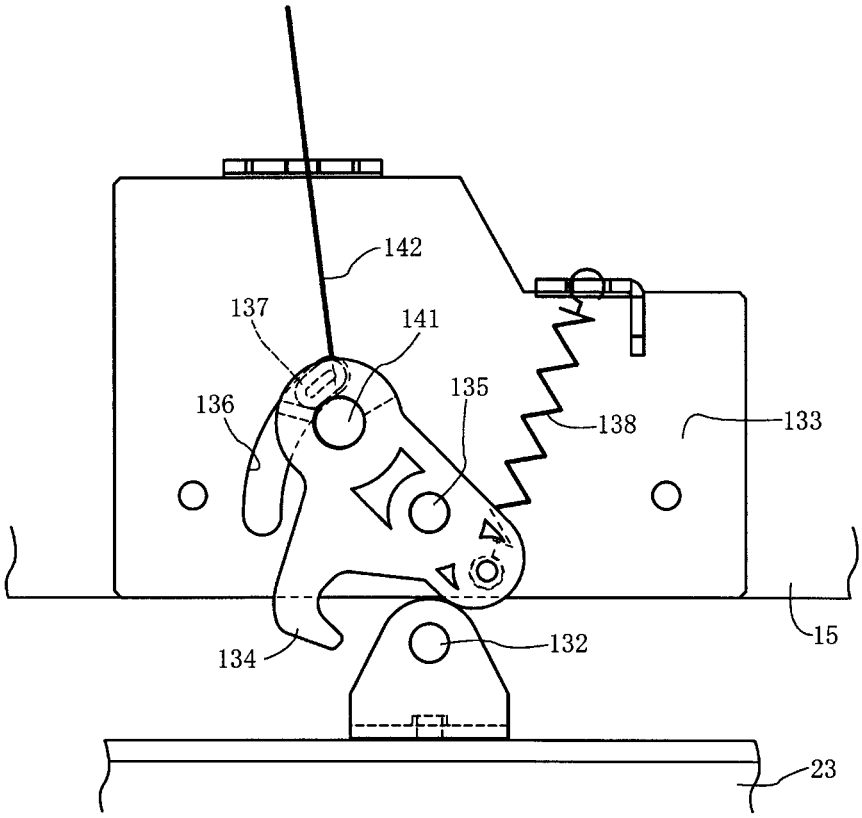
FIG. 32 Plan view of the latch of the base and the latch receiver of the foot end treatment door in the incubator according to the embodiment of the present invention, illustrating the state in which the latch and the latch receiver disengage mutually.

As shown in FIG. 28, a latch receiver 132 is mounted on the base 15 side face of the frame body 106 of the foot end treatment door 23. As shown in FIGS. 31 and 32, a latch base-plate 133 is mounted on a part of the base 15 which is opposite to the latch receiver 132 of the foot end treatment door 23 when raised to its highest position. A latch 134 is mounted on this latch base-plate 133. The latch 134 can swing about a center shaft 135 while a guided shaft 137 is guided by a guide hole 136 in the latch base-plate 133.

The latch 134 is urged by an extension coil spring 138 from the position shown in FIG. 31 to the position shown in FIG. 31, that is, in the direction in which the latch 134 engages with the latch receiver 132. One end of a wire 142 is fixed to the driven shaft 141 of the latch 134. This wire 142 extends through the base 15 and through one of the pair of posts 25 for the canopy 27. As shown in FIGS. 33 and 34, the other end of the wire 142 is attached to this post 25, near its top. A pressed body 143 is fixed in the vicinity of the other end. A pressing body 144 is attached to the vicinity of the lower end of one of the pair of posts 26 for the canopy 27. As the post 26 slides in the post 25, the pressing body 144 also rises and lowers within the post 25.

If the canopy 27 is raised to the vicinity of its highest position, the pressing body 144 presses the pressed body 143 upward from below, as shown in FIG. 34. The wire 142 is pulled by the pressure and the latch 134 swings, by the pull, to the position shown in FIG. 32 against the urge from the extension coil spring 138. If the latch 134 is at the position shown in FIG. 32, the latch 134 does not engage with the latch receiver 132 and accordingly the foot end treatment door 23 can be lowered from its highest position, for example, by pulling the lever 111 forward as described above.

However, if the canopy 27 is lowered even a little from the vicinity of its highest position, the pressing body 144 does not press the pressed body 143 upward from below, as shown in FIG. 33. As a result, the wire 142 is not pulled and consequently the latch 134 swings to the position shown in FIG. 31 by urge from the extension coil spring 138. If the latch 134 at in the position shown in FIG. 31, the latch 134 engages with the latch receiver 132 and accordingly the foot end treatment door 23 cannot be lowered from its highest position even if the lever 111 is pulled forward.

In the incubator 11 according to the present embodiment, in order to circulate air, whose temperature or others is controlled, within the newborn chamber 16, a suction opening (not shown) for circulated air is formed in the newborn chamber 16 near the foot end treatment door 23. On account of this, an air curtain by blown out air can be created at the left and right treatment windows 33 that are open as a result of the left and right treatment doors 22 being lowered; however, an air curtain by blown out air cannot be created at the foot end treatment window 34 that is open as a result of the foot end treatment door 23 being lowered.

However, in the incubator 11 according to the present embodiment, when the canopy 27 is raised to any position other than its highest position and therefore the top of the newborn chamber 16 is open, an air curtain can be created at the left and right treatment window 33 where an air curtain can be created and which is open, and the foot end treatment window 34, where an air curtain cannot be created, is surely closed by the foot end treatment door 23 restrained from being lowered, as described above. This reduces the incidence of failure of the inside of the newborn chamber 16 to maintain appropriate physiological environment for a newborn. Additionally, when the canopy 27 has been raised to its highest position, the foot end treatment window 34 can also be opened, making it easier to treat a newborn in the newborn chamber 16.

Figure 35:
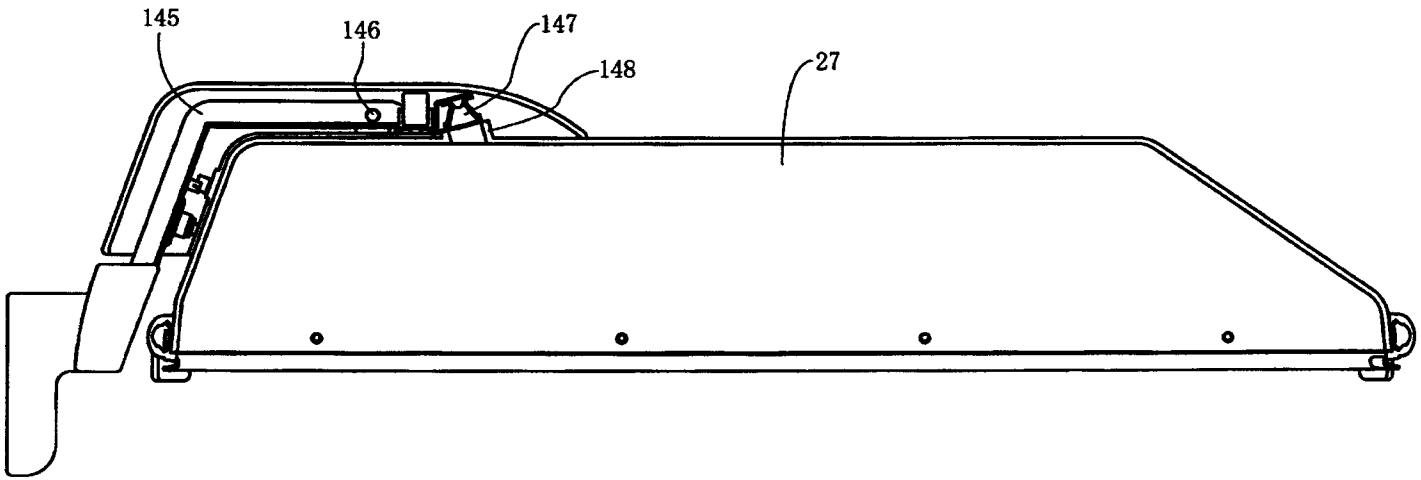
FIG. 35 Vertical sectional view of the canopy and the vicinity thereof of the incubator according to the embodiment of the present invention.

On the other hand, as shown in FIG. 35, one end of the canopy 27 is suspended, via a support shaft 146, from a support arm 145 attached to one of the pair of posts 26, left and right. If the canopy 27 is subjected to impact or others from part of the body of a treating person or others, the other end of the canopy 27, in particular, may bend, resulting in damage to the canopy 27. However, in the incubator 11 according to the present embodiment, when the canopy 27 is raised to any position other than its highest position, the foot end treatment door 23 is prevented from being lowered, as described above.

Thus, the foot end treatment door 23 also supports the canopy 27 and hence the canopy 27 is supported stably at both the one and other ends. Accordingly, even if the canopy 27 is subjected to impact or others from part of the body of a treating person or others near the lowest position of the canopy 27, damage to the canopy 27 is prevented. On the other hand, at the highest position of the canopy 27, there is less possibility that the canopy 27 is subjected to impact or others from part of the body of a treating person or others. Therefore, the canopy 27 does not have to be supported except at the one end, thus making it possible to open the foot end treatment door 23 which corresponds to the other end of the canopy 27. In the present embodiment, the lowering of the foot end treatment door 23 is prevented by a mechanical mechanism for engaging the latch 134 and the latch receiver 132 together, but it may be prevented by, for example, an electrical mechanism.

(6) Warming or Heating with an Infrared Heater

When both the canopy 27 and the infrared heater 28 are raised to their highest positions, as shown in FIGS. 3 to 5 and 34, the bed 21 and a newborn on the bed 21 can be warmed by radiating infrared rays from the infrared heater 28. In addition, when the canopy 27 is lowered to its lowest position and the infrared heater 28 is raised to its highest position as shown in FIGS. 36 and 37, the outer surface of the canopy 27 can be heated by radiating infrared rays from the infrared heater 28. By virtue of heat conduction from the outer surface of the canopy 27, the inner surface of the canopy 27, the outer and inner surfaces of the left and right treatment doors and foot end treatment door 23 and the inside of the newborn chamber 16 are also heated to a certain degree.

When the outer surface of the canopy 27 and others are heated in the state shown in FIG. 36 or 37, power supplied to the infrared heater 28 is automatically reduced to, for example, about ⅕ of that when the bed 21 and a newborn on the bed 21 are warmed in the state shown in FIGS. 3 to 5 and 34, in order to prevent the canopy 27 from softening or deforming. In addition, when the infrared heater 28 is lowered to the state shown in FIG. 2 in the course of heating the outer surface of the canopy 27 and others in the state shown in FIGS. 36 and 37, supply of power to the infrared heater 28 is automatically stopped.

(7) Irradiation in the Newborn Chamber

As shown in FIG. 35, the canopy 27 is provided with a light source 147. This light source 147 serves as a light source for illumination and a light source for light therapy. Since light of various wavelengths or white light is used for light therapy, the light source 147 is configured to enable selection of the wavelength of light radiated from the light source 147.

In order to reduce any adverse effect of light on a newborn in the newborn chamber of an adjacent incubator, the light source 147 is disposed within a recess 148 in the upper surface of the canopy 27, thus making it difficult for light radiated from the light source 147 to reach the adjacent incubator regardless of whether the light source is used for illumination or light therapy. In the present embodiment, the single light source 147 serves as a light source for illumination and as a light source for light therapy, but a plurality of light sources may be placed side by side in the recess 148.

(8) Four States of Incubator

As described above, the incubator 11 in the present embodiment can be in the following four states: a state of an open type incubator in which, as shown FIG. 4, the canopy 27 and the infrared heater 28 are at their highest positions, and the left and right treatment doors 22 and foot end treatment door 23 are at their intermediate positions; a state of a closed type incubator in which, as shown in FIGS. 36 and 37, the canopy 27 is at its lowest position, the left and right treatment doors 22 and foot end treatment door 23 are at their highest positions, and the infrared heater 28 is at its highest position, such that the infrared heater 28 can heat the canopy 27 and others; a state of a closed type incubator in which, as shown FIGS. 2 and 33, the canopy 27 is at its lowest position, the left and right treatment doors 22 and foot end treatment door 23 are at their highest positions, the infrared heater 28 is at its lowest position, and this incubator is easily conveyable; and a state of a resuscitation treatment device in which, as shown in FIG. 3, the canopy 27 and the infrared heater 28 are at their highest positions, and the left and right treatment doors 22 and foot end treatment door 23 are at their lowest positions.

Incidentally, also in the closed type incubator shown in FIGS. 2 and 33, the left and right treatment windows 33 can be opened by lowering the left and right treatment doors 22 to their lowest positions, as shown in FIG. 1. Also, in the closed type incubator shown in FIGS. 36 and 37, the left and right treatment windows 33 can be opened by lowering the left and right treatment doors 22 to their lowest positions, although not shown.

INDUSTRIAL APPLICABILITY

The present invention can be utilized for, for example, manufacturing an incubator in which a newborn who cannot adjust its body temperature and others by itself is protected and nurtured by providing appropriate physiological environment for the newborn.

REFERENCE SIGNS LIST

11 Incubator
16 Newborn chamber
22 Left and right treatment doors
23 Foot end treatment door
25 Posts (heater raising and lowering mechanism)
26 Posts (heater raising and lowering mechanism)
27 Canopy
28 Infrared heater
33 Left and right treatment windows
34 Foot end treatment window
48 Treatment door support (treatment door raising and lowering mechanism)
53 Fitting hole (treatment door raising and lowering mechanism)
54 Fitting hole (treatment door raising and lowering mechanism)
58 Lever (treatment door raising and lowering mechanism)
64 Pin (treatment door raising and lowering mechanism)
67 Helical compression spring
92 Movable body (treatment door raising and lowering mechanism)
93 Link (treatment door raising and lowering mechanism)
94 Link (treatment door raising and lowering mechanism)
102 Guide groove
111 Lever (treatment door raising and lowering mechanism)
115 Helical compression spring
124 Pin (treatment door raising and lowering mechanism)
128 Fitting portion (treatment door raising and lowering mechanism)
132 Latch receiver
134 Latch
138 Extension coil spring
142 Wire
143 Pressed body
144 Pressing body

The invention claimed is:

1. An incubator comprising:

a treatment window formed in a side of a newborn chamber;

a treatment door that opens and closes the treatment window;

a canopy that closes and opens a top of the newborn chamber by lowering and rising;

a heater that heats the newborn chamber, characterized in that the incubator further comprises:

a treatment door raising and lowering mechanism capable of lowering and raising the treatment door between its highest position where the treatment window is closed and its lowest position where the treatment window is opened, and capable of stopping the treatment door at its intermediate position between the highest position and lowest position; and a heater raising and lowering mechanism that lowers and raises the heater along a path displaced from a path for lowering and raising the canopy, wherein the treatment window includes a first treatment window, the treatment door includes a first treatment door, and the treatment door raising and lowering mechanism comprises treatment door supports that raise and lower the first treatment door along the first treatment window in order that the first treatment door closes and opens the first treatment window, and wherein each of the treatment door supports has guide grooves extending vertically, and guided rails that slide in the guide grooves extend along edges of both sides of the first treatment door.

2. The incubator according to claim 1, wherein the heater raising and lowering mechanism comprises a first post and a second post that is nested in the first post and is slidable within the first post.

3. The incubator according to claim 1, being able to be switched among:

a state in which the canopy and the heater are at their highest positions, and the treatment door is at its intermediate position;

a state in which the canopy is at its lowest position, the treatment door is at its highest position, and the heater is at its highest position;

a state in which the canopy is at its lowest position, the treatment door is at its highest position, and the heater is at its lowest position; and a state in which the canopy and the heater are at their highest positions, and the treatment door is at its lowest position.

4. An incubator comprising:

a treatment window formed in a side of a newborn chamber;

a treatment door that opens and closes the treatment window;

a canopy that closes and opens a top of the newborn chamber by lowering and rising;

a heater that heats the newborn chamber, characterized in that the incubator further comprises:

a treatment door raising and lowering mechanism capable of lowering and raising the treatment door between its highest position where the treatment window is closed and its lowest position where the treatment window is opened, and capable of stopping the treatment door at its intermediate position between the highest position and lowest position; and a heater raising and lowering mechanism that lowers and raises the heater along a path displaced from a path for lowering and raising the canopy, wherein the treatment window includes a first treatment window, the treatment door includes a first treatment door, and the treatment door raising and lowering mechanism comprises treatment door supports that raise and lower the first treatment door along the first treatment window in order that the first treatment door closes and opens the first treatment window, and, wherein the treatment door raising and lowering mechanism comprises:

a fitting hole and a pin, the pin, when the first treatment door is raised or lowered, fitting into the fitting hole, thereby preventing the lowering of the first treatment door; and a lever that releases or prevents the fitting.

5. The incubator according to claim 4, wherein the fitting hole includes two fitting holes, and the two fitting holes are formed so that one of them corresponds to the highest position and the other corresponds to the intermediate position.

6. The incubator according to claim 4, having a helical compression spring that urges the pin in a direction of the fitting.

7. The incubator according to claim 4, wherein the heater raising and lowering mechanism comprises a first post and a second post that is nested in the first post and is slidable within the first post.

8. The incubator according to claim 4, being able to be switched among:

a state in which the canopy and the heater are at their highest positions, and the treatment door is at its intermediate position;

a state in which the canopy is at its lowest position, the treatment door is at its highest position, and the heater is at its highest position;

a state in which the canopy is at its lowest position, the treatment door is at its highest position, and the heater is at its lowest position; and a state in which the canopy and the heater are at their highest positions, and the treatment door is at its lowest position.

9. An incubator comprising:

a treatment window formed in a side of a newborn chamber;

a treatment door that opens and closes the treatment window;

a canopy that closes and opens a top of the newborn chamber by lowering and rising;

a heater that heats the newborn chamber, characterized in that the incubator further comprises:

a treatment door raising and lowering mechanism capable of lowering and raising the treatment door between its highest position where the treatment window is closed and its lowest position where the treatment window is opened, and capable of stopping the treatment door at is intermediate position between the highest position and lowest position; and a heater raising and lowering mechanism that lowers and raises the heater along a path displaced form a path for lowering and raising the canopy, wherein the treatment window includes a first and a second treatment window, the treatment door includes a first and a second treatment door, and the treatment door raising and lowering mechanism comprises treatment door supports that raise and lower the first treatment door along the first treatment window in order that the first treatment door closes and opens the first treatment window, and wherein the treatment door raising and lowering mechanism comprises:

a movable body capable of moving close to and away from the second treatment window that is closed and opened by the second treatment door;

a pair of links in which basal-end attaching parts and leading-end attaching parts are mounted on the movable body and the second treatment door respectively so as to be rotatable, and an interval between the leading-end attaching parts is narrower than that between the basal-end attaching parts; and a guide groove that, when the movable body moves close to and away from the second treatment window, guides the pair of links so that the pair of links move downward and close to, and move upward and away from, the second treatment window.

10. The incubator according to claim 9, wherein the treatment door raising and lowering mechanism comprises:

a recess and a pin, the pin, when the second treatment door is raised, engaging with the recess, thereby preventing the second treatment door from lowering from its highest position; and a lever that releases the engaging.

11. The incubator according to claim 10, having a helical compression spring that urges the pin in a direction of the engaging.

12. The incubator according to claim 9, wherein the treatment door raising and lowering mechanism comprises:

a fitting portion and a pin, the pin, when the second treatment door is raised or lowered, fitting into the fitting portion, thereby preventing the second treatment door from lowering from its intermediate position; and a lever that releases or prevents the fitting.

13. The incubator according to claim 12, having a helical compression spring that urges the pin in a direction of the fitting.

14. The incubator according to claim 9, wherein the canopy is supported at one end thereof, the second treatment door corresponds to the other end of the canopy, a latch receiver is attached to the second treatment door, and a latch is provided for restraining the second treatment door from lowering by engaging with the latch receiver when the canopy is at any position other than its highest position.

15. The incubator according to claim 14, wherein the treatment door raising and lowering mechanism comprises:

an extension coil spring that urges the latch to a position for the engaging;

a wire, one end of which is fixed to the latch and the other end of which is fixed to a pressed body; and a pressing body that rises and lowers together with the canopy and, in its highest position, presses the pressed body upward from below, thereby releasing the latch from the engaging against the urge by the extension coil spring.

16. The incubator according to claim 9, wherein the heater raising and lowering mechanism comprises a first post and a second post that is nested in the first post and is slidable within the first post.

17. The incubator according to claim 9, being able to be switched among:

a state in which the canopy and the heater are at their highest positions, and the first treatment door is at its intermediate position;

a state in which the canopy is at its lowest position, the first treatment door is at its highest position, and the heater is at its highest position;

a state in which the canopy is at its lowest position, the first treatment door is at its highest position, and the heater is at its lowest position; and a state in which the canopy and the heater are at their highest positions, and the first treatment door is at its lowest position.

* * * * *